US010831154B2

(12) United States Patent
Shige

(10) Patent No.: US 10,831,154 B2
(45) Date of Patent: Nov. 10, 2020

(54) IMAGE FORMING APPARATUS INCLUDING EXHAUST DUCT LEADING AIR INSIDE APPARATUS BODY TO EXTERIOR

(71) Applicant: Sharp Kabushiki Kaisha, Sakai, Osaka (JP)

(72) Inventor: Daisuke Shige, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 188 days.

(21) Appl. No.: 15/941,018

(22) Filed: Mar. 30, 2018

(65) Prior Publication Data

US 2018/0284691 A1 Oct. 4, 2018

(30) Foreign Application Priority Data

Mar. 31, 2017 (JP) ..... 2017-070450
Mar. 31, 2017 (JP) ..... 2017-070517

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01); *G03G 2221/1645* (2013.01)

(58) Field of Classification Search
CPC ..... G03G 21/206; G03G 15/2017; G03G 2221/1645; G03G 15/2039
See application file for complete search history.

(56) References Cited

U.S. PATENT DOCUMENTS 5,023,654 A * 6/1991 Matsumoto ..... G03B 27/32 355/106
2005/0129424 A1* 6/2005 Park ..... G03G 15/107 399/93
2009/0052933 A1* 2/2009 Sata ..... G03G 21/206 399/92
2011/0200494 A1* 8/2011 Tanaka ..... B41J 29/13 422/211
2011/0211860 A1* 9/2011 Shimoyama ..... G03G 15/2064 399/93
2013/0243471 A1* 9/2013 Ikeda ..... G03G 21/206 399/93

(Continued)

FOREIGN PATENT DOCUMENTS

CN 105425566 A 3/2016
CN 106547188 A 3/2017

(Continued)

*Primary Examiner* — Susan S Lee
(74) *Attorney, Agent, or Firm* — Keating & Bennett, LLP

(57) ABSTRACT

An image forming apparatus includes an exhaust device. The exhaust device includes a duct main body and a duct mounting member. The duct main body and the duct mounting member are integrated with each other to form a first air passage and a second air passage that communicate a periphery of a fixing unit and an exhaust port of an apparatus main body. The first air passage is provided with a first fan and a first air passage filter. The second air passage is provided with a second fan and a second air passage filter. Each of the first fan and the second fan is a centrifugal fan. Each of the first air passage filter and the second air passage filter includes a filter for collecting at least ultrafine particle (UFP).

21 Claims, 15 Drawing Sheets

(56) References Cited

U.S. PATENT DOCUMENTS

| | | | | |
|---|---|---|---|---|
| 2015/0168913 | A1* | 6/2015 | Yamaguchi | G03G 21/206 399/92 |
| 2016/0077488 | A1 | 3/2016 | Umemoto et al. | |
| 2017/0082973 | A1 | 3/2017 | Omichi et al. | |
| 2019/0332053 | A1* | 10/2019 | Kawasumi | G03G 21/206 |

FOREIGN PATENT DOCUMENTS

| | | | | |
|---|---|---|---|---|
| JP | 03225375 | A * | 10/1991 | G03G 21/1619 |
| JP | 2007-316418 | A | 12/2007 | |

* cited by examiner

IMAGE FORMING APPARATUS INCLUDING EXHAUST DUCT LEADING AIR INSIDE APPARATUS BODY TO EXTERIOR

CROSS REFERENCE OF RELATED APPLICATION

The disclosures of Japanese patent application Nos. 2017-70450 and 2017-70517 both filed on Mar. 31, 2017 are incorporated by reference.

BACKGROUND OF THE INVENTION

Field of the Invention

The present invention relates to an image forming apparatus, and more specifically, an image forming apparatus having an air passage for discharging air in a periphery of a fixing portion to an external of an apparatus main body.

Description of the Related Art

An example of a related art is disclosed in a Japanese patent application laying-open No. 2007-316418 [G03G 21/00] (Literature 1) laid-open on Dec. 6, 2007. An image forming apparatus disclosed in this literature 1 comprises a conveying guide having an exhaust air passage that communicates a periphery of the fixing portion and an external of an apparatus main body. The exhaust air passage is provided with a fan for sucking air in the periphery of the fixing portion to discharge the air to the external of the apparatus main body, and a filter arranged on a downstream side in an airflow direction by the fan.

In recent years, regulation with respect to a discharged amount of fine particle called UFP (Ultra Fine Particle) having a particle size of 0.1 μm or less generated by heating paper and toner at the fixing portion of the image forming apparatus to the external of the image forming apparatus has been strengthened, so that a measure is required. In order to reduce the discharged amount to the external of the image forming apparatus of this UFP, it is necessary to provide a high-density filter for collecting the UFP in the exhaust air passage.

However, in the image forming apparatus disclosed in this literature 1, if a dedicated high-density collection filter is provided in the exhaust air passage, the amount of air that flow in the exhaust air passage decreases and the amount of air that is taken in from the periphery of the fixing portion decreases. If the amount of the air taken in from the periphery of the fixing portion decreases, there is a possibility of failing to catch the UFP generated in the fixing portion. When failing to catch the UFP generated in the fixing portion, there is a problem that a possibility that the UFP discharged to the external of the image forming apparatus becomes high.

SUMMARY OF THE INVENTION

It is a primary object of the present invention to provide a novel image forming apparatus.

It is another object of the present invention to provide an image forming apparatus capable of collecting substances such as UFP generated in an internal of the image forming apparatus with a dedicated filter without failing to catch, and preventing from being discharged to an external of the image forming apparatus.

A first embodiment is an image forming apparatus, comprising: an apparatus main body; a fixing portion; an exhaust duct; a first air passage filter; and a first centrifugal fan. The fixing portion is configured to fix a toner image that is transferred on a recording medium with heating. The exhaust duct is configured to form a first air passage that is formed in a quadrangle cylindrical shape having a bottom surface and a top surface, and has a first air inlet through which air from the fixing portion passes, and leads the air to an external of the apparatus main body. The first air passage filter is provided in the first air passage. The first air passage filter includes a filter for ultrafine particle (UFP) for collecting at least the UFP. The first centrifugal fan is provided on a side of the first air inlet compared to the first air passage filter in the first air passage, and sucks the air through the first air inlet and pressure-feeds the air to the first air passage filter. The first centrifugal fan is, for example, a sirocco fan, a turbofan or the like.

According to the first embodiment, it is possible to collect substances such as UFP generated in an internal of the image forming apparatus with a dedicated filter without failing to catch, and to prevent from being discharged to an external of the apparatus.

A second embodiment is the image forming apparatus according to the first embodiment, wherein the first air passage includes a first compression space that is formed between the first centrifugal fan and the first air passage filter.

A third embodiment is the image forming apparatus according to the second embodiment, wherein the first compression space has a flow passage cross-sectional area that becomes larger toward a downstream side of an airflow.

A fourth embodiment is the image forming apparatus according to the first embodiment, wherein an axial direction of the first centrifugal fan is set in an up and down direction, and the first centrifugal fan is arranged on a side of the top surface of the first air passage, and the first air passage includes a first air intake space formed between the first centrifugal fan and the first air inlet.

According to each of the second to fourth embodiments, it is possible to prevent an intake flow rate of the air that is sucked from a periphery of the fixing portion from decreasing, and to efficiently collect substances such as UFP.

A fifth embodiment is the image forming apparatus according to the first embodiment, further comprising a first axial flow fan that is provided between the first centrifugal fan and the first air passage filter in the first air passage, and sends air pressure-fed by the first centrifugal fan to the first air passage filter.

According to the fifth embodiment, it is possible to increase a flow amount of the air passing the first air passage filter.

A sixth embodiment is the image forming apparatus according to the fifth embodiment, further comprising a main body side air passage that is formed in an interior of the apparatus main body separated from the first air passage, wherein the main body side air passage is connected to a communicating port formed on an upstream side compared to the first axial fan in an airflow.

According to the sixth embodiment, it is possible to suck air from a space other than a space above the fixing portion, whereby substances such as UFP can be sucked more efficiently. Moreover, it is possible to reduce the number of components and thus to reduce a manufacturing cost.

A seventh embodiment is the image forming apparatus according to the first embodiment, further comprising a second air passage that is formed in parallel to the first air passage in the exhaust duct, and has a second air inlet through which air from the fixing portion passes, and leads the air to the external of the apparatus main body; a second air passage filter provided in the second air passage; and a second centrifugal fan that is provided on a side of the second air inlet compared to the second air passage filter in the second air passage, and sucks the air through the second air inlet and pressure-feeds the air to the second air passage filter.

According to the seventh embodiment, it is possible to suck air around the fixing portion evenly.

An eighth embodiment is the image forming apparatus according to the seven embodiment, wherein the second air passage includes a second compression space formed between the second centrifugal fan and the second air passage filter.

A ninth embodiment is the image forming apparatus according to the eighth embodiment, wherein the second compression space has a flow passage cross-sectional area that becomes larger toward a downstream side of an airflow.

A tenth embodiment is the image forming apparatus according to the seventh embodiment, wherein an axial direction of the second centrifugal fan is set in an up and down direction, and the second centrifugal fan is arranged on a side of the top surface of the second air passage, and the second air passage includes a second air intake space formed between the second centrifugal fan and the second air inlet.

According to each of the eighth to tenth embodiments, it is possible to prevent an intake flow rate of the air sucked from a periphery of the fixing portion from decreasing.

An eleventh embodiment is the image forming apparatus according to the seventh embodiment, further comprising a second axial flow fan that is provided between the second centrifugal fan and the second air passage filter in the second air passage, and sends air pressure-fed by the second centrifugal fan to the second air passage filter.

According to the eleventh embodiment, it is possible to increase a flow amount of the air passing the second air passage filter.

A twelfth embodiment is the image forming apparatus according to the eleventh embodiment, further comprising a main body side air passage that is formed in an interior of the apparatus main body separated from the second air passage, wherein the main body side air passage is connected to a communicating port formed on an upstream side compared to the second axial fan in an airflow.

According to the twelfth embodiment, it is possible to suck air from a space other than a space above the fixing portion, whereby substances such as UFP can be suctioned more efficiently. Moreover, it is possible to reduce the number of components and thus to reduce a manufacturing cost.

A thirteenth embodiment is the image forming apparatus according to the tenth embodiment, wherein a part of the first air passage and a part of the second air passage are overlap with each other in the up and down direction.

According to the thirteenth embodiment, a space can be used effectively.

A fourteenth embodiment is the image forming apparatus according to the first embodiment, further comprising a heater that is provided between the fixing portion and the exhaust duct.

A fifteenth embodiment is the image forming apparatus according to the seventh embodiment, further comprising a heater that is provided between the fixing portion and the exhaust duct.

According to each of the fourteenth and fifteenth embodiments, it is possible to suppress a generation amount of UFP and thus to reduce an amount of UFP discharged to the external of the apparatus main body.

A sixteenth embodiment is the image forming apparatus according to the first embodiment, wherein the exhaust duct is constituted with a plurality of separable members.

According to the sixteenth embodiment, it is possible to manufacture the exhaust duct of complicated structure easily.

A seventeenth embodiment is the image forming apparatus according to the sixteenth embodiment, wherein at least one of the plurality of members is a filter holding member that holds the first air passage filter, the filter holding member being detachably attached to the exhaust duct.

According to the seventeenth embodiment, an exchange or replacement work of the first air passage filter is simple.

An eighteenth embodiment is the image forming apparatus according to the seventeenth embodiment, wherein the filter holding member has internal structure according to number and sizes of filter held in an internal of the filter holding member.

According to the eighteenth embodiment, it is possible to easily change filter performance.

A nineteenth embodiment is the image forming apparatus according to the sixteenth embodiment, wherein the first air passage includes the first centrifugal fan and a first compression space that is formed between the first centrifugal fan and the first air passage filter, and at least one of the plurality of members comprises the first centrifugal fan and forms the first air intake space.

According to the nineteenth embodiment, it is possible to manufacture the exhaust duct of complicated structure more easily.

A twentieth embodiment is the image forming apparatus according to the sixteenth embodiment, further comprising a first axial flow fan that is provided between the first centrifugal fan and the first air passage filter in the first air passage, and sends the air pressure-fed by the first centrifugal fan to the first air passage filter, wherein at least one of the plurality of members is a fan holding member that holds the first centrifugal fan.

According to the twentieth embodiment, it is possible to manufacture the exhaust duct of complicated structure more easily.

A twenty-first embodiment is the image forming apparatus according to the sixteenth embodiment, further comprising a second air passage that is formed in parallel to the first air passage in the exhaust duct, and has a second air inlet through which air from the fixing portion passes, and leads the air to the external of the apparatus main body; the second air passage filter provided in the second air passage; and a second centrifugal fan that is provided on a side of the second air inlet compared to the second air passage filter in the second air passage, and sucks air through the second air inlet and pressure-feeds the air to the second air passage filter, wherein the second air passage includes a second compression space formed between the second centrifugal fan and the second air passage filter, and at least one of the plurality of members comprises the second centrifugal fan, and forms the second compression space.

According to the twenty-first embodiment, it is possible to manufacture the exhaust duct of complicated structure more easily.

The above mentioned objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

First Embodiment

Figure 1:
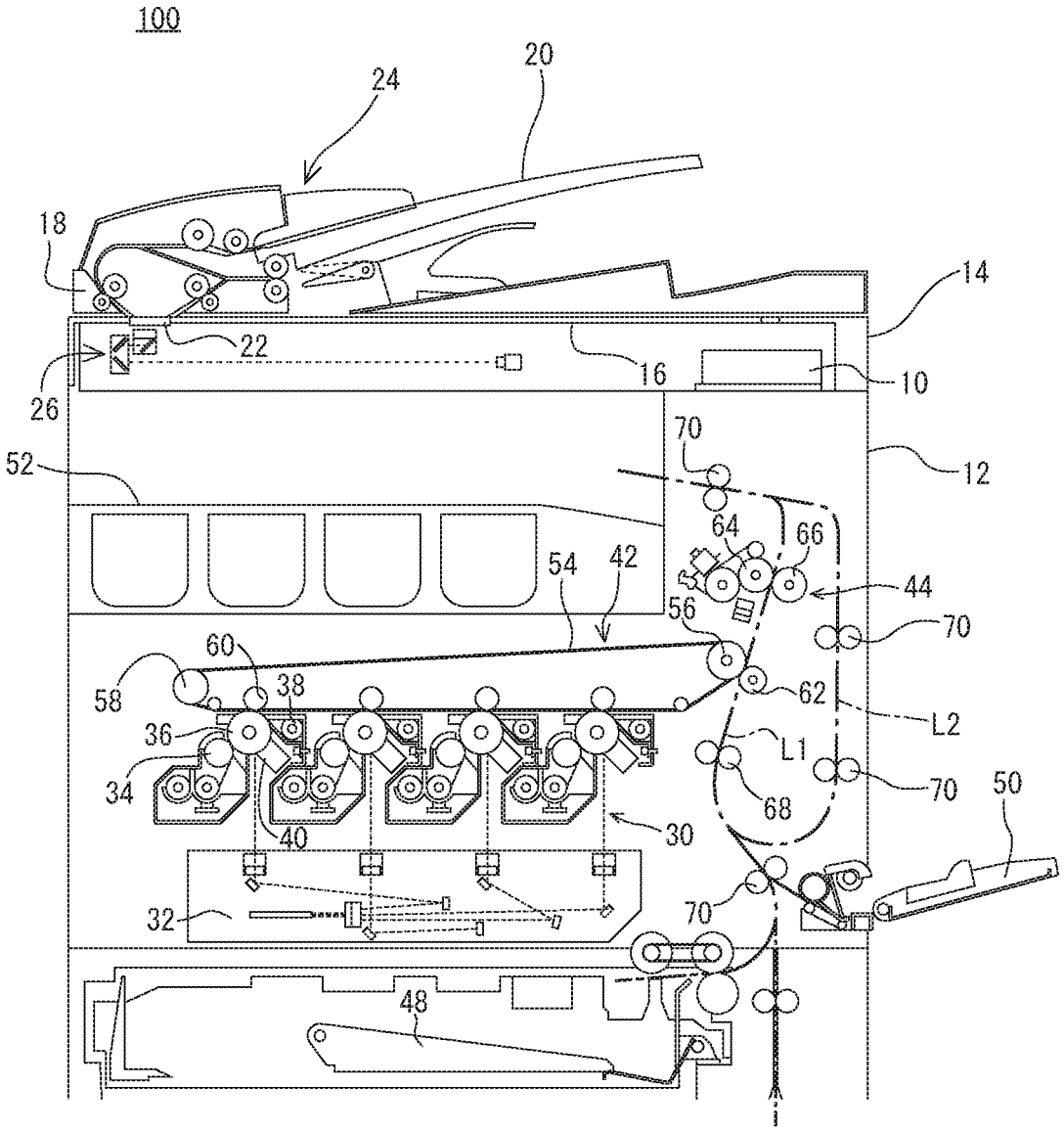
FIG. 1 is an illustration view showing schematic structure of an image forming apparatus that is a first embodiment according to the present invention.

With reference to FIG. 1, an image forming apparatus 100 that is an embodiment according to the present invention is an image forming apparatus of an electrophotography system, and forms (prints) a multicolor or monochromatic image on a top surface and a bottom surface of a sheet (recording medium) by passing through processes of charge, exposure, development, transfer and a heat fixing.

In this first embodiment, the image forming apparatus 100 is a multifunction machine (MFP: Multifunction Peripheral) having a copying function, a printer function, a scanner function, a facsimile function, etc. However, the image forming apparatus 100 does not need to be limited to a multifunction machine, and may be any one of a copying machine, a printer and a facsimile. Moreover, the image forming apparatus 100 may be a color machine, and may be a monochrome machine.

First, basic structure of the image forming apparatus 100 will be schematically described. As shown in FIG. 1, the image forming apparatus 100 includes an apparatus main body 12 provided with an image reading portion 14 and an image forming portion 30.

The image reading portion 14 is arranged above the image forming portion 30. This image reading portion 14 is provided with an original platen 16 that is formed of transparent material. An original platen cover 18 is attached above the original platen 16 via a hinge etc. so as to be opened and closed freely. This platen cover 18 is provided with an ADF (Automatic Document Feeder) 24 that automatically feeds an original that is placed on an original tray 20 one by one to an image reading position 22. Moreover, although illustration is omitted, an operating portion that receives an input operation such as a printing start instruction etc. by a user is provided on a front surface side of the original platen 16.

Moreover, the image reading portion 14 is incorporated with an image reading unit 26 that comprises a light source, a plurality of mirrors, a focusing lens, a line sensor, etc. The image reading unit 26 exposes a surface of an original by the light source, and leads a reflected light that is reflected from the surface of the original to the focusing lens by the plurality of mirrors. Then, the reflected light is focused onto photoreceptor elements of the line sensor by the focusing lens. The line sensor detects brightness and chromaticity of the reflected light that is focused onto the photoreceptor elements, and produces image data based on an image of the original surface. As the line sensor, a CCD (Charge Coupled Device), a CIS (Contact Image Sensor), etc. may be used.

The image forming portion 30 comprises an exposure unit 32, a developing unit 34, a photoreceptor drum 36, a photoreceptor cleaner unit 38, a charger 40, a transfer unit 42, a fixing unit (fixing portion) 44, etc., and forms an image on a sheet that is fed from a sheet feeding cassette 48 or a manual sheet feeding tray 50, and discharges a sheet having been formed with image onto a sheet discharge tray 52. As image data for forming an image on a sheet, image data read by the image reading portion 14, image data transmitted from an external computer, etc. can be utilized.

In addition, image data treated in the image forming apparatus 100 corresponds to a color image of four (4) colors of black (K), cyan (C), magenta (M) and yellow (Y). Therefore, the developing unit 34, the photoreceptor drum 36, the photoreceptor cleaner unit 38 and the charger 40 are respectively provided by four (4) so that four (4) kinds of latent images corresponding to respective colors can be formed, and four (4) image stations are constituted by these components.

The photoreceptor drum 36 is an image bearing member that a photosensitive layer is formed on a surface of a circular cylindrical substrate having conductivity, and the charger 40 is a member for charging a surface of the photoreceptor drum 36 at a predetermined electric potential. Moreover, the exposure unit 32 is constituted as a laser scanning unit that comprises a laser diode (LD) and polygon mirror, etc., and arranged below the photoreceptor drum 36. The exposure unit 32 forms an electrostatic latent image according to the image data on the surface of the photoreceptor drum 36 by exposing the surface of the photoreceptor drum 36 having been charged. The developing unit 34 visualizes the electrostatic latent image that is formed on the photoreceptor drum 36 with toners of four (4) colors (YMCBK). Moreover, the photoreceptor cleaner unit 38 removes the toner that remains on the surface of the photoreceptor drum 36 after developing and transfer.

The transfer unit 42 comprises an intermediate transfer belt 54, a driving roller 56, a driven roller 58, four (4) intermediate transfer rollers 60, a secondary transfer roller 62, etc., and is arranged above the photoreceptor drum 36. In addition, the transfer unit 42 does not necessarily need to be provided with the intermediate transfer belt 54, and structure that the toner image on the photoreceptor drum 36 is directly transferred onto a sheet can also be adopted.

The intermediate transfer belt 54 is an endless flexible belt, and is formed of a synthetic resin, rubber or the like appropriately blended with conductive materials, such as carbon black. The intermediate transfer belt 54 is suspended by the driving roller 56 and the driven roller 58, and disposed so that an outer peripheral surface of the intermediate transfer belt 54 is brought into contact to an outer peripheral surface of the photoreceptor drum 36. Then, the intermediate transfer belt 54 is moved circularly in a predetermined direction according to driving rotation of the driving roller 56.

The driving roller 56 is provided rotatably around its axis line by a driver portion not illustrated. The driven roller 58 is rotated according to a circularly movement of the intermediate transfer 54, and allies a predetermined tension to the intermediate transfer belt 54 to prevent slackening of the intermediate transfer belt 54.

The intermediate transfer roller 60 is arranged at each position opposite via the intermediate transfer belt 54 to each photoreceptor drum 36. At the time of image forming, a transfer electric field is formed between the photoreceptor drum 36 and the intermediate transfer belt 54 by applying a predetermined voltage (primary transfer voltage) to the intermediate transfer roller 60. Then, the toner image that is formed on the periphery surface of the photoreceptor drum 36 is transferred to the periphery surface of the intermediate transfer belt 54 due to this transfer electric field.

The secondary transfer roller 62 is provided so as to press the intermediate transfer belt 54 with the driving rollers 56. At the time of image forming, the transfer electric field is formed between the intermediate transfer belt 54 and the secondary transfer roller 62 by applying a predetermined voltage (secondary transfer voltage) to the secondary transfer roller 62. Then, the toner image that is formed on the periphery surface of the intermediate transfer belt 54 is transferred (secondarily transferred) onto a sheet due to this transfer electric field while the sheet passes through a transfer NIP region between the intermediate transfer belt 54 and the secondary transfer roller 62.

The fixing unit 44 comprises a heat roller 64 and a pressure roller 66, and is arranged above the secondary transfer roller 62. The heat roller 64 is controlled to be rendered at a predetermined fixing temperature, and when a sheet passes a NIP region between the heat roller 64 and the pressure roller 66, the toner image that is transferred to the sheet is melted, mixed and pressured, whereby the toner image can be heat-fixed on the sheet.

In such the apparatus main body 12, there is formed with a first sheet feeding path L1 for feeding a sheet placed on a sheet feed cassata 48 or a manual sheet feed tray 50 to a sheet discharge tray 52 via a sheet stop roller 68, the secondary transfer roller 62 and the fixing unit 44. However, the sheet stop roller 68, the secondary transfer roller 62 and the fixing unit 44 are disposed in parallel with each other in a vertical (up and down) direction. Therefore, the sheet paper path L1 of the first embodiment is a vertical feeding path that feeds a sheet in the vertical direction. Moreover, there is a formed with a second sheet feeding path L2 for returning, when performing duplex printing to the sheet, the sheet that the printing has been finished on a top surface and passed through the fixing unit 44 to the first sheet feeding path L1 on an upstream side in a sheet feeding direction of the secondary transfer roller 62. A plurality of feeding rollers 70 for auxiliary imparting a driving force to the sheet are appropriately provided in the first paper feeding path L1 and the second paper feeding path L2.

When performing simplex printing in the apparatus main body 12, a sheet placed on the sheet feeding cassette 48 or a manual sheet feeding tray 50 is led one by one to the first sheet feeding path L1, and fed by the feeding rollers 70 to the sheet stop roller 68. Then, the sheet is fed at a timing that a tip end of the sheet and a tip end of the toner image on the intermediate transfer belt 54 are consistent with each other by the sheet stop roller 68, whereby the toner image can be transferred onto the sheet. Thereafter, an unfixed toner on the sheet is melted and fixed when the sheet passing through the fixing unit 44 (fixing NIP region), and the sheet is discharged on the sheet discharge tray 52.

On the other hand, if performing duplex printing, the sheet is fed backward to be led to the second sheet feeding path L2 by reversely rotating the feeding roller 70 when a tail end of the paper that simplex printing has been completed and passed through the fixing unit 44 reaches the feeding roller 70 near the sheet discharge tray 52. The sheet led to the second sheet feeding path L2 is fed in the second sheet feeding path L2 by the feeding rollers 70, and is further led to the first sheet feeding path L1 on an upstream side of a sheet feeding direction from the sheet stop roller 68. Since the top and bottom of the sheet is reversed at this time, when the sheet passes the secondary transfer roller 62 and the fixing unit 44 after passing the sheet stop roller 68, printing is performed on the bottom surface of the sheet.

Moreover, an exhaust device 10 is provided in the interior of the apparatus main body 12. The exhaust device 10 is arranged above the fixing unit 44.

Figure 2:
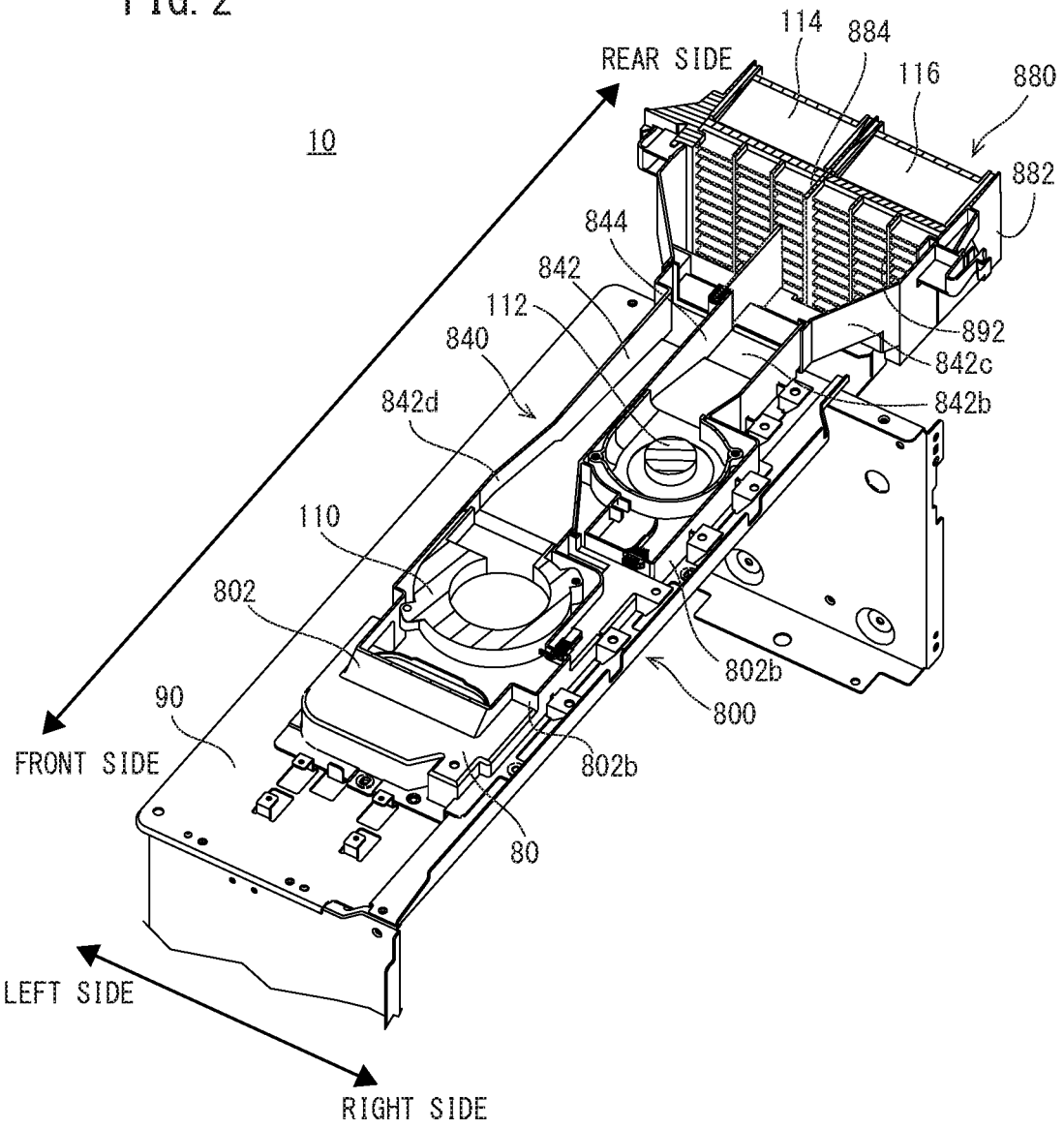
FIG. 2 is a perspective view showing an exhaust device provided on the image forming apparatus of FIG. 1, when viewed from an upper front.
Figure 3:
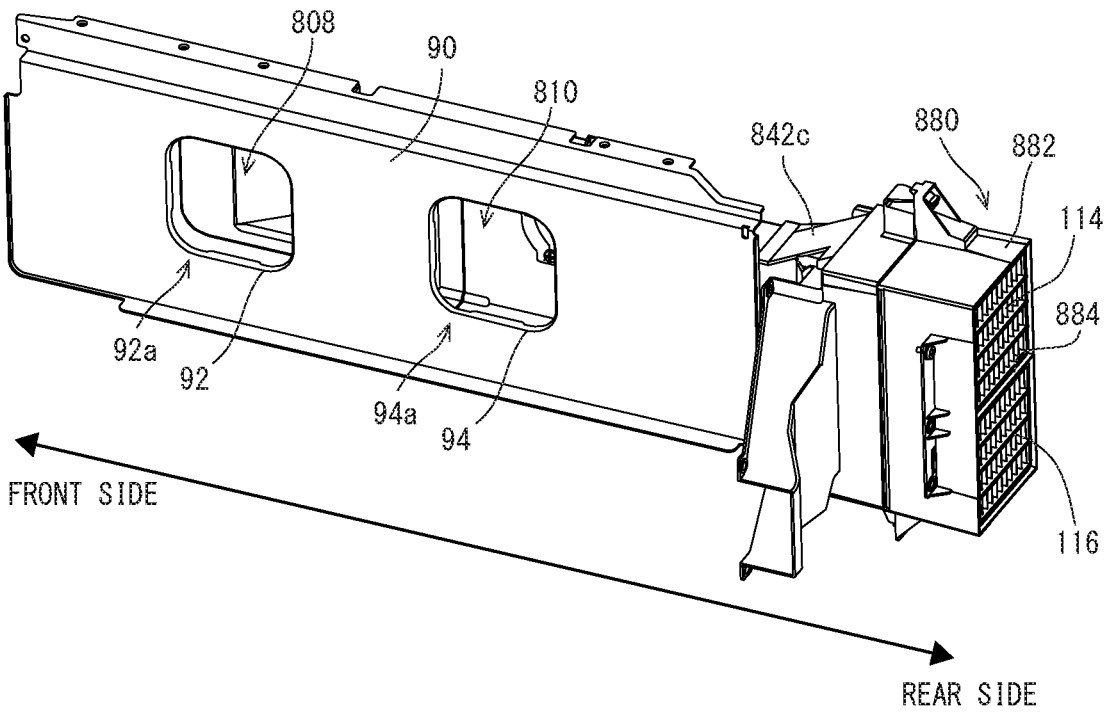
FIG. 3 is a perspective view showing the exhaust device in a state where a duct mounting member is attached, when viewed from a lower rear.
Figure 4:
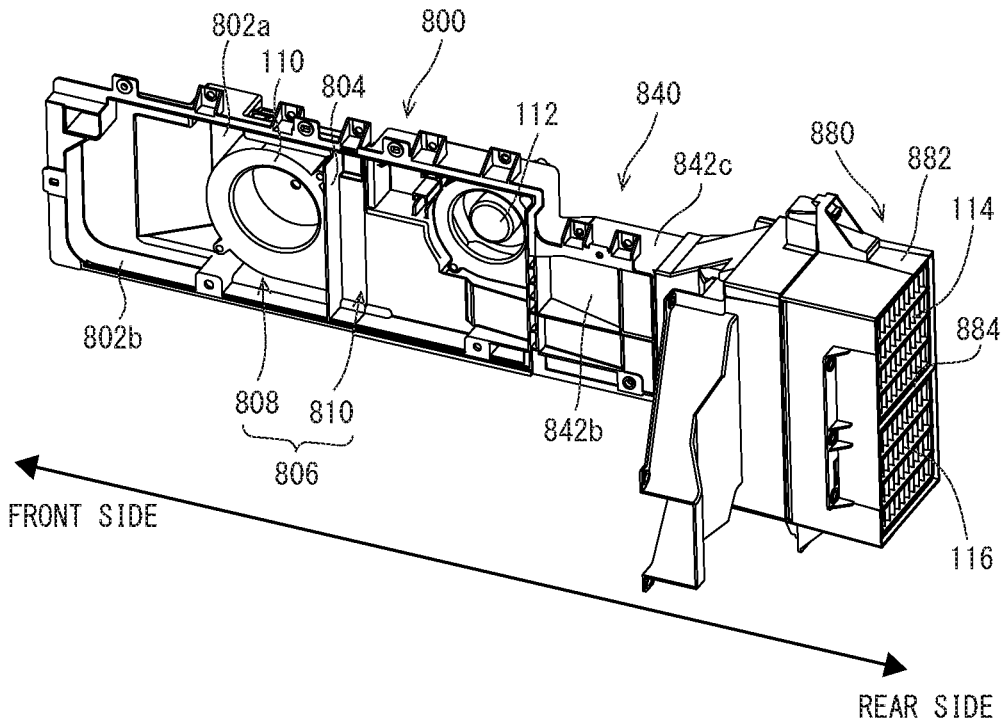
FIG. 4 is a perspective view showing the exhaust device in a state where the duct mounting member is detached, when viewed a lower rear.
Figure 5:
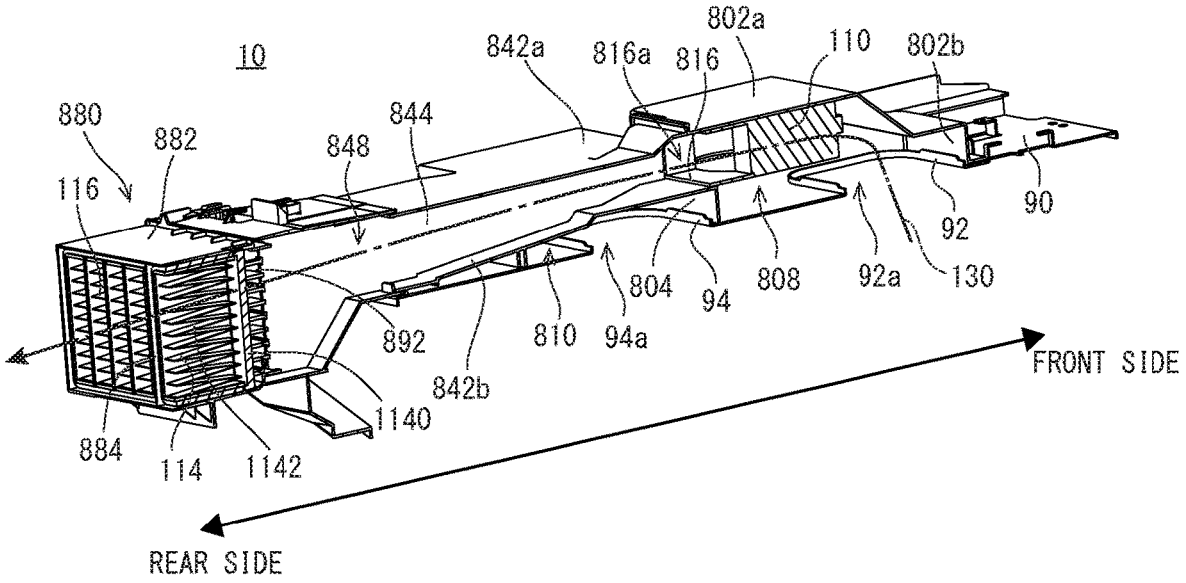
FIG. 5 is a schematic sectional view showing a first air passage of the exhaust device.
Figure 6:
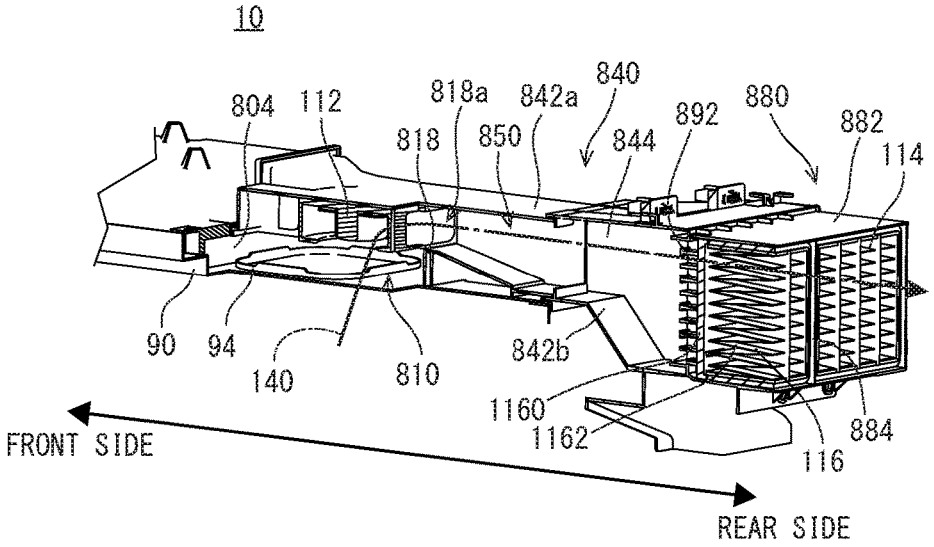
FIG. 6 is a schematic sectional view showing a second air passage of the exhaust device.
Figure 7:
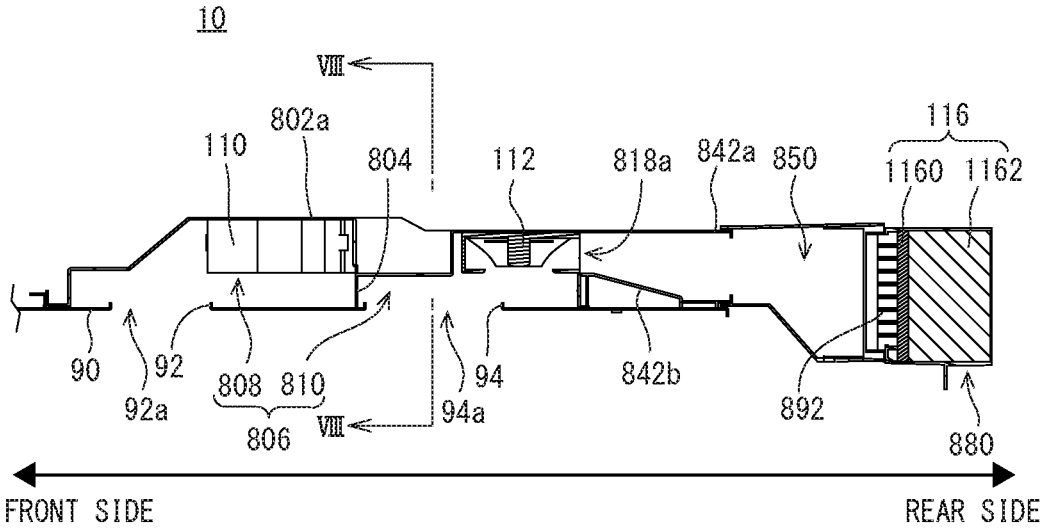
FIG. 7 is a schematic sectional view showing internal structure of the exhaust device, when viewed from a right side surface portion of the image forming apparatus.
Figure 8:
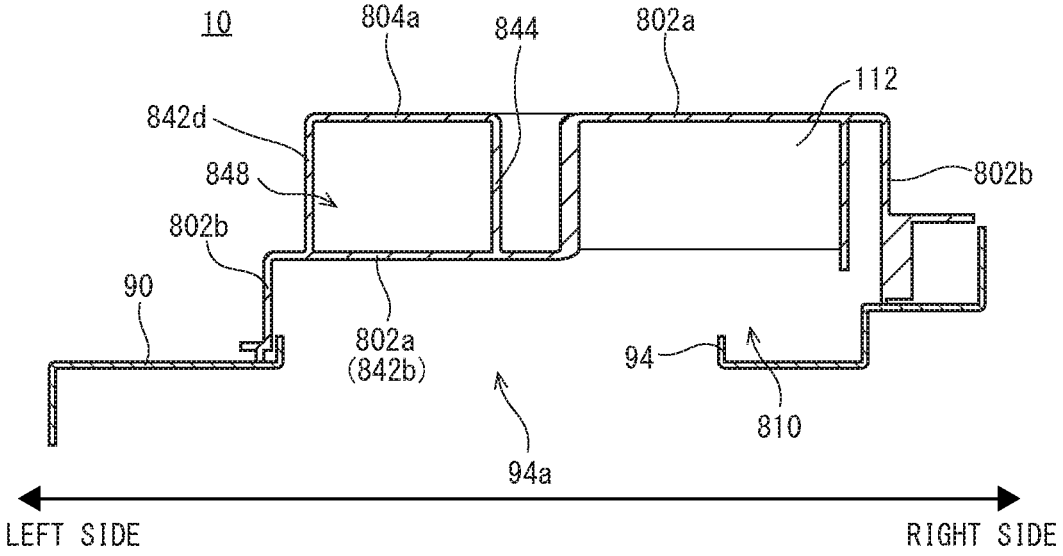
FIG. 8 is a sectional view at a line VIII-VIII in FIG. 7.

FIG. 2 is a perspective view showing the exhaust device 10 provided on the image forming apparatus 100 of FIG. 1, when viewed from the upper front. FIG. 3 is a perspective view showing the exhaust device 10 in a state where a duct mounting member 90 is attached, when viewed from the lower rear. FIG. 4 is a perspective view showing the exhaust device 10 in a state where the duct mounting member 90 is detached, when viewed from the lower rear. FIG. 5 is a schematic sectional view showing a first air passage 130 of the exhaust device 10. FIG. 6 is a schematic sectional view showing a second air passage 140 of the exhaust device 10. FIG. 7 is a schematic sectional view showing internal structure of the exhaust device 10, when viewed from a right side surface of the image forming apparatus 100. FIG. 8 is a sectional view at a line VIII-VIII in FIG. 7. In addition, in FIG. 2, the sectional view is of a state where a top wall of a duct main body 80 is omitted.

As shown in FIG. 2 to FIG. 4, the exhaust device 10 includes the duct main body 80, the duct mounting member 90, a first fan 110, a second fan 112, a first air passage filter 114 and a second air passage filter 116.

The duct main body 80 and the duct mounting member 90 constitute an exhaust duct integrally, and the first air passage 130 and the second air passage 140 that is in parallel to the first air passage 130 are formed in this exhaust duct. The first air passage 130 and the second air passage 140 are formed in quadrangle cylindrical shapes. The first air passage 130 and the second air passage 140 have a first air inlet 92*a* and a second air inlet 94*a* that make air from the fixing unit 44, and pass to lead the air to the external of the apparatus main body 12.

The first fan 110 is provided in the first air passage 130, and the second fan 112 is provided in the second air passage 140. The air in a periphery of the fixing unit 44 is sucked into the first air passage 130 and the second air passage 140 by the first fan 110 and the second fan 112, respectively, and is discharged to the external of the apparatus main body 12 (image forming apparatus 100) through the first air passage 130 and the second air passage 140. Therefore, in the exhaust device 10, a side of the fixing unit 44 is an upstream side of a flow of air (airflow), and a side of a discharge port of the apparatus main body 12 is a downstream of the airflow.

Each of the first air passage 130 and the second air passage 140 is divided into a plurality of spaces in a direction of a flow of the air. In the first embodiment, the first air passage 130 and the second air passage 140 respectively include air intake spaces 808 and 810, compression spaces 848 and 850 and exhaustion spaces, sequentially from the upstream side of the airflow.

Although described later in detail, the air intake spaces 808 and 810 are formed by the duct mounting member 90 and the duct main body 80, and the compression spaces 848 and 850 and the exhaustion spaces are formed in the interior of the duct main body 80.

The duct mounting member 90 is a metallic plate (sheet metal), for example. The duct mounting member 90 is attached to the apparatus main body 12, and the duct main body 80 is attached by fixing member, such as a screw(s), to an upper side of the duct mounting member 90.

Moreover, a first opening end 92 and a second opening end 94 are formed in the duct mounting member 90. The first opening end 92 and the second opening end 94 are arranged in the mutually separate positions (different positions). Specifically, the first opening end 92 and the second opening end 94 are arranged in parallel with each other in a front and rear direction (an axial direction of the heat roller 64 and the pressure roller 66). The first opening end 92 is arranged in a predetermined position on a front surface side compared to the second opening end 94. Moreover, the second opening end 94 is arranged in a position away from a first position that the first opening end 92 is arranged. Then, the first air inlet 92*a* is formed by this first opening end 92. Moreover, the second air inlet 94*a* is formed by this second opening end 94.

Therefore, the second air inlet 94*a* is arranged in a position away from the first air inlet 92*a*. Moreover, the first air inlet 92*a* is arranged on a front surface side compared to a center portion of the fixing unit 44 in the front and rear direction. Moreover, the second air inlet 94*a* is arranged on a rear surface side compared to the center portion of the fixing unit 44 in the front and rear direction.

The first air inlet 92*a* (first opening end 92) and second air inlet 94*a* (second opening end 94) are arranged in a periphery of the fixing unit 44. For example, the first air inlet 92*a* and the second air inlet 94*a* are located substantially directly above the fixing unit 44. Specifically, the first air inlet 92*a* and the second air inlet 94*a* are located substantially directly above the fixing NIP region of the fixing unit 44, or substantially directly above a sheet feeding path that is extended in substantially vertical direction after the fixing NIP region.

The duct main body 80 is a member formed of a synthetic resin, for example. The duct main body 80 consists of a plurality of sections. Specifically, the duct main body 80 includes an air intake section 800, a compression section 840 and a filter holding section 880 sequentially from the upstream in the airflow direction.

The air intake section 800 forms air intake spaces 808 and 810 together with the duct mounting member 90. Moreover, the compression section 840 forms compression spaces 848 and 850, and the filter holding section 880 forms exhaustion spaces. In the following, detailed structure of each section will be described.

As shown in FIG. 4 to FIG. 6, the air intake section 800 is formed in the foremost face side of the duct main body 80. The air intake section 800 includes a flow passage forming portion 802 and a boundary wall 804. The flow passage forming portion 802 includes a top wall 802*a* and side walls 802*b*. The top wall 802*a* is a tabular member extended substantially horizontally in the front and rear direction. The top wall 802*a* seals an upper side of the air intake section 800. Moreover, a part of the top wall 802*a* constitutes a top wall in a front surface side of the duct main body 80. Each of the side walls 802*b* has an end portion of an upper side (upper end edge) that is connected to the top wall 802*a*, and extended downward. When attaching the duct mounting member 90 to the duct main body 80, an end portion of a lower side (lower end edge) of the side wall 802*b* is abutted (closely contacted) to the duct mounting member 90.

Therefore, a space 806 that is defined by the top wall 802*a* of the air intake section 800, the side walls 802*b* of the air intake section 800 and the duct mounting member 90, and is extended in the up and down direction. As shown in FIG. 4 and FIG. 7, the space 806 is partitioned into a front surface side and a rear surface side by the boundary wall 804. A space on the front surface side of the boundary wall 804 serves a first air intake space 808 that is a part of the first air passage 130, and a space on the rear surface side of the boundary wall 804 serves a second air intake space 810 that is a part of the second air passage 140.

However, the boundary wall 804 is arranged between the first opening end 92 and the second opening end 94 in the front and rear direction. Therefore, as shown in FIG. 3, the first air intake space 808 is communicated via the first air inlet 92*a* to the periphery of the fixing unit 44, and the second air intake space 810 is communicated via the second air inlet 94*a* to the periphery of the fixing unit 44.

Moreover, a flow passage cross-sectional area of the first air intake space 808 (sizes in the front and rear and the left and right directions of the first air intake space 808 defined by the side wall 802*b* and the boundary wall 804) is set to be larger than an opening area of the first air inlet 92*a*. Moreover, a flow passage cross-sectional area of the second air intake space 810 (sizes in the front and rear and the left and right directions of the second air intake space 810 defined by the side wall 802*b* and the boundary wall 804) is set to be larger than an opening area of the second air inlet 94*a*.

Moreover, as shown in FIG. 4 to FIG. 6, a first fan 110 and a second fan 112 are provided in the air intake section 800.

The first fan 110 is provided in the first air intake space 808. However, the first fan 110 is arranged at the topmost portion (top surface side) of the first air intake space 808. That is, the first fan 110 is arranged with an interval to a tip end portion of the first air intake space 808 (abutting portion to the duct mounting member 90). Specifically, the first fan 110 is attached to the top wall 802*a* of the flow passage forming portion 802 on the front surface side compared to the boundary wall 804. Moreover, the first fan 110 is arranged on the rear surface side of the first air intake space

808 in the front and rear direction. Furthermore, the first fan 110 is arranged on the left side of the first air intake space 808 in the left and right direction.

The second fan 112 is provided in the second air intake space 810. However, the second fan 112 is arranged in the topmost portion (top surface side) of the second air intake space 810. That is, the second fan 112 is arranged with an interval to a bottom surface in a tip end portion of the second air intake space 810 (abutting portion to the duct mounting member 90). Specifically, the second fan 112 is attached to the top wall 802*a* of the flow passage forming portion 802 on the rear surface side compared to the boundary wall 804. Moreover, the second fan 112 is arranged on the rear surface side of the second air intake space 810 in the front and rear direction. Furthermore, the second fan 112 is arranged on an opposite side to the first fan 110 (right side of the second air intake space 810) in the left and right direction.

Each of the first fan 110 and the second fan 112 is a centrifugal fan having a plurality of blades (vanes), for example, a sirocco fan (multi-blade fan) or a turbo fan. For each of the first fan 110 and the second fan 112, an axial direction of a rotation axis of a plurality of blades is set in the up and down direction. Therefore, the first fan 110 and the second fan 112 each sucks air (air intakes) from a lower space and pressure-feeds (discharges) the air with a centrifugal force in the horizontal direction. Therefore, a direction of the airflow in each of the first air intake space 808 and the second air intake space 810 is perpendicularly bent by the first fan 110 and the second fan 112.

However, the first fan 110 provided in the front surface side (first air intake space 808) is a fan larger than the second fan 112 provided in the rear surface side (second air intake space 810). Since the first air passage is longer than the second air passage and has high airflow resistance, by making the first fan larger than the second fan, it is possible to secure substantially the same exhaust airflow rate as the exhaust airflow rate in the second air passage.

Moreover, a discharge direction of the first fan 110 and a discharge direction of the second fan 112 are set to the rear surface side.

As shown in FIG. 5, a third opening end 816 is formed in the side wall on the rear surface side of the passage forming portion 802 so as to correspond to a discharge port of the first fan 110. A first communicating port 816*a* is formed by the third opening end 816. With this first communicating port 816*a*, the first air intake space 808 is communicated to a first compression space 848 described later.

Moreover, as shown in FIG. 6, a fourth opening end 818 is formed in the side wall on the rear surface side of the passage forming portion 802 so as to correspond to a discharge port of the second fan 112. A second communicating port 818*a* is formed by the fourth opening end 818. With this second communicating port 816*a*, the second air intake space 810 is communicated to a second compression space 850 described later.

As shown in FIG. 2, FIG. 5 and FIG. 6, the compression section 840 is formed on the downstream side (rear surface side) of the air intake section 800. The compression section 840 includes a flow passage forming portion 842 and a boundary wall 844. The flow passage forming portion 842 includes a top wall 842*a*, a bottom wall 842*b*, a first side wall 842*c* and a second side wall 842*d*. Each of the top wall 842*a*, the bottom wall 842*b*, the first side wall 842*c* and the second side wall 842*d* is a tabular member extended in the front and rear direction. The top wall 842*a* seals an upper side of the compression section 840. The bottom wall 842*b* is provided so as to face the top wall 842*a*, and seals the lower side of the compression section 840. The first side wall 842*c* connects a periphery edge on the right side of the top wall 842*a* and a periphery edge on the right side of the bottom wall 842*b*. The second side wall 842*d* connects a periphery edge on the left side of the top wall 842*a* and a periphery edge on the left side of the bottom wall 842*b*.

Accordingly, there is firmed with a quadrangle cylindrical space that is defined by the top wall 842*a*, the bottom wall 842*b*, the first side wall 842*c* and the second side wall 842*d* and extends in the front and rear direction. This space is partitioned into a left side space and a right side space by the boundary wall 844. The left side space of the boundary wall 844 serves the first compression space 848 that is a part of the first air passage 130, and the right space of the boundary wall 844 serves the second compression space 850 that is a part of the second air passage 140.

However, as described above, the first air intake space 808 is arranged on the upstream side (front surface side) compared to the second air intake space 810. Accordingly, the first compression space 848 is longer than the second compression space 850.

Moreover, a flow passage cross-sectional area of each of the first compression space 848 of and the second compression space 850 is larger than an opening area of corresponding one of the first fan 110 and the second fan 112. Moreover, a size (length) in the front and rear direction of the second compression space 850 is larger than a size in the front and rear direction of the second fan 112. Therefore, the second compression space 850 has a sufficient volume (capacity) for accepting the air pressure-fed from the second fan 112. The first compression space 848 has a further larger volume (capacity) because of being longer than the second compression space 850.

Furthermore, as shown in FIG. 8, a part of the front surface side of the first compression space 848 overlaps with an upper left of the second air intake space 810. Therefore, in a portion that the first compression space 848 and the second air intake space 810 overlap with each other in the up and down direction, a width of the upper side of the second air intake space 810 becomes narrow. However, since a portion of the lower side of the second air intake space 810 does not overlap with the first compression space 848 in the up and down direction, a width of the lower side of the second air intake space 810 does not become narrow. Therefore, the second air intake space 810, the entire in the left and right direction in the portion of the lower side can be used as an air intake space. That is, it is possible to set the second air intake space 810 as large as possible.

Furthermore, as shown in FIG. 2, FIG. 5 and FIG. 6, each of the first compression space 848 and the second compression space 850 has a flow passage cross-sectional area that becomes larger toward the downstream side of the airflow (toward the rear surface side from the front surface side). That is, each of the first compression space 848 and the second compression space 850 functions as a diffuser portion that widens an airflow passage, and rectifies and pressurizes the air discharged from corresponding one of the first fan 110 and the second fan 112.

The top wall 842*a* of the flow passage forming portion 842 is provided in substantially horizontal direction. On the other hand, the bottom wall 842*b* of the flow passage forming portion 842 includes an inclined portion descending toward the rear surface side from the front surface side. Therefore, each of the first compression space 848 and the second compression space 850 has a width in the up and down direction that becomes larger toward the rear surface side from the front surface side.

Moreover, each of the first side wall 842*c* and the second side wall 842*dd* includes an inclined portion that is inclined so as to be separated from the boundary wall 844 in the left and right direction toward the rear surface side from the front surface side. Therefore, each of the first compression space 848 and the second compression space 850 has a width in the left and right direction that becomes larger toward the rear surface side from the front surface side.

As described above, since the widths in the up and down direction and the left and right direction of each of the first compression space 848 and the second compression space 850 becomes larger toward the rear surface side from the front surface side, a flow passage cross-sectional area becomes larger toward the rear surface side from the front surface side.

As shown in FIG. 2, FIG. 5, FIG. 6 and FIG. 7, the filter holding section 880 is formed on the downstream side (rear surface side) compared to the compression section 840. The filter holding section 880 includes a flow passage forming portion 882 and a boundary wall 884. The flow passage forming portion 882 is a quadrangle cylindrical member extending in the front and rear direction, and is provided continuously to the flow passage forming portion 842. A space (exhaust space) having a substantially rectangular cross-section is formed in the internal of the flow passage forming portion 882.

The exhaust space is partitioned into a left side space and a right side space by the boundary wall 884. The left side space of the boundary wall 884 serves a first exhaust space that is a part of the first air passage 130, and the right side space of the boundary wall 884 serves a second exhaust space that is a part of the second air passage 140.

A front edge of the boundary wall 884 is abutted (closely contacted) to a rear edge of the boundary wall 844 of the compression section 840. Therefore, a front end portion of the first exhaust space is communicated to the first compression space 848, and a front end portion of the second exhaust space is communicated to the second compression space 850. Moreover, a rear end portion of each of the first exhaust space and the second exhaust space is connected to a discharge port in the rear surface side of the apparatus main body 12. Therefore, the first exhaust space and the second exhaust space are respectively communicated to the external of the apparatus main body 12 via the discharge port of the apparatus main body 12.

However, a flow passage cross-sectional area of the first exhaust space and a flow passage cross-sectional area of the second exhaust space are substantially the same. Moreover, the flow passage cross-sectional area of the first exhaust space is substantially the same as a flow passage cross-sectional area in an end portion of the rear surface side of the first compression space 848. Furthermore, the flow passage cross-sectional area of the second exhaust space is substantially the same as a flow passage cross-sectional area in an end portion of the rear surface side of the second compression space 850.

As described above, the first air passage 130 and the second air passage 140 are formed. As shown in FIG. 5, in the first air passage 130, the first air inlet 92*a* serves as an air inlet (first air intake port), and the rear end portion of the first exhaust space serves as an air outlet (first air discharge port). Moreover, as shown in FIG. 6, in the second air passage 140, the second air inlet 94*a* serves as an air inlet (second air intake port), and the rear end portion of the second exhaust space serves as an air outlet (second air discharge port).

However, the first air inlet 92*a* is arranged on the front surface side, and the second air inlet 94*a* is arranged on the rear surface side. Therefore, the first air passage 130 leads the air in the front surface side of the periphery of the fixing unit 44 to the external of the apparatus main body 12. Moreover, the second air passage 140 leads the air in the rear surface side of the periphery of the fixing unit 44 to the external of the apparatus main body 12.

As shown in FIG. 2 to FIG. 6, the first air passage filter 114 provided in the first exhaust space (first air passage 130) and the second air passage filter 116 provided in the second exhaust space (second air passage 140) are held in the filter holding section 880.

Moreover, the filter holding section 880 includes a louver 892 provided across the first exhaust space and the second exhaust space. Then, as shown in FIG. 5 and FIG. 6, the first air passage filter 114 and the second air passage filter 116 are arranged so as to be brought into contact to the rear surface side of the louver 892. That is, the louver 892 functions also as a positioning member in the front and rear direction for the first air passage filter 114 and the second air passage filter 116.

However, each of the first air passage filter 114 and the second air passage filter 116 is arranged so that a position of the end portion on the rear surface side is located in a position the same as an edge of the rear surface side of corresponding one of the passage forming portion 882 of the filter holding section 880, or slightly front surface side of that position. Therefore, the first air passage filter 114 and the second air passage filter 116 are entirely accommodated in the filter holding section 880.

The first air passage filter 114 includes a first kind of filter 1140 and a second kind of filter 1142.

Moreover, the second air passage filter 116 includes a first kind of filter 1160 and a second kind of filter 1162.

Each of the first kind of filters 1140 and 1160 is a VOC collecting filter for collecting a volatile organic compound (VOC), ozone, etc.

Each of the second kind of filters 1142 and 1162 is a UFP collecting filter for collecting an ultrafine particle (UFP).

The second kind of filters (UFP filters) 1142 and 1162 are set to have higher density than the first kind of filters (VOC filters) 1140 and 1160 in order to capture ultrafine particles having a particle size of 0.1 μm or less. That is, the UFP filters 1142 and 1162 have filter performance higher than filter performance of the VOC filters 1140 and 1160. Therefore, the UFP filters 1142 and 1162 have airflow resistance higher than airflow resistance of the VOC filters 1140 and 1160. Moreover, the UFP filters 1142 and 1162 are set to have sizes in the front and rear direction (thicknesses) larger than sizes in the front and rear direction (thicknesses) of the VOC filters 1140 and 1160.

Moreover, in the exhaust device 10 of the first embodiment, the VOC filters 1140 and 1160 are arranged on the upstream side (front surface side) compared to the UFP filters 1142 and 1162, respectively.

A flow of the air in the exhaust device 10 of the first embodiment will be specifically described with reference to FIG. 5 with taking the first air passage 130 as an example. In addition, since the first air passage 130 and the second air passage 140 are the same about the flow of the air, the description made in the following is applied also to the second air passage 140.

In the first air passage 130, if the first fan 110 is operated, air is sucked by the first fan 110 from the first air intake space 808 below the first fan 110. At this time, the first air intake space 808 becomes negative pressure. Therefore, the air in the periphery of the fixing unit 44 is sucked into the first air intake space 808 (first air passage 130) through the first air inlet 92*a*, and further sucked by the first fan 110.

Moreover, the air sucked by the first fan 110 is discharged to the first compression space 848 through the first communicating port 816*a*. Then, the air discharged to the first compression space 848 flows into the first exhaust space, and is discharged to the external of the apparatus main body 12 passing through the first air passage filter 114.

As described above, the first air passage filter 114 includes the UFP filter 1142 with large airflow resistance. Therefore, since a velocity of the airflow decreases when the air flowing into the first exhaust space passes through the first air passage filter 114, the flow rate (exhaust flow rate) of the air to be discharged to the external of the apparatus main body 12 passing through the first air passage filter 114 decreases. That is, the exhaust flow rate of the air decreases on the downstream side (exhaust side) in the airflow after the first fan 110.

However, in the first embodiment, since a centrifugal fan having a high static pressure (force for discharging out the air) is used as the first fan 110, even if the exhaust flow rate of the air on the exhaust side decreases after the first fan 110, the air can be further compressed and fed. As a result, the air on the inlet side of the first air passage filter 114 is compressed, and the air pressure on the inlet side of the first air passage filter 114 increases (there occurs a pressure difference between the inlet and the outlet), and therefore, it is possible to make a large amount of air pass through the first air passage filter 114 without decreasing the exhaust flow rate. That is, since a large amount of air can be passed even if it is a dedicated filter having high airflow resistance for collecting the UFP, it is possible to prevent an intake flow rate of the air sucked from the periphery of the fixing unit 44 from decreasing. Therefore, it is possible to efficiently collect the UFP generated around the fixing unit 44, and to prevent the UFP from being leaked and emitted out to the external of the image forming apparatus 100.

Moreover, since it is possible to effectively compress a large amount of air in a space on the upstream side of the first air passage filter 114 by providing the first compression space 848 between the first fan 110 and the first air passage filter 114, the air immediately before the first air passage filter 114 can be effectively compressed to be rendered a high pressure (compared to external air). Therefore, it becomes possible to make sufficient amount of air pass through the first air passage filter 114 more stably, and thus, to prevent the intake flow rate of the air sucked from the periphery of the fixing unit 44 from decreasing.

Furthermore, since the flow passage cross-sectional area becomes larger toward the downstream side of the airflow in the first compression space 848, no disturbance occurs in the air to be sent into the first compression space 848, and accordingly, it is possible to send the air to the first air passage filter 114 at a uniform flow velocity and to recover the UFP and the fine particles efficiently and uniformly or evenly by the first air passage filter 114.

Furthermore, in the first embodiment, since the spaces below the first fan 110 and the second fan 112 can be widely used as the first air intake space 808 and the second air intake space 810, flow passage resistance decreases, whereby a large amount of air can be sucked. Therefore, it is possible to prevent the intake flow rate of the air sucked from the periphery of the fixing unit 44 from decreasing.

Moreover, according to the first embodiment, since the air in the periphery of the fixing unit 44 can be sucked from the first inlet port 92*a* and the second inlet port 94*a* that is arranged in a position separated from the first inlet port 92*a* around the fixing unit 44, it is possible to suck the air around the fixing unit 44 evenly.

Furthermore, according to the first embodiment, since the first compression space 848 and the second compression space 850 are arranged in parallel to each other in left and right, spaces in the up and down direction in the exhaust device 10 can be use effectively. Therefore, it is possible to set sizes of the up and down direction of the first compression space 848 and the second compression space 850 as large as possible.

Furthermore, according to the first embodiment, since a part of first compression space 848 (first air passage 130) is arranged above the second air intake space 810 (second air passage 140), the spaces in the up and down direction in the exhaust device 10 can be used effectively. Moreover, since the lower side of the second intake space 810 does not overlap with the first compression space 848 in the up and down direction, a volume of the second intake space 810 can be made almost the same as a volume of the first intake space 808.

In addition, although two air passages, the first air passage 130 and the second air passage 140, are formed in the first embodiment, there is no necessity of being limited to this, a third air passage may be provided or only a first air passage may be provided.

Second Embodiment

Since an image forming apparatus 100 of the second embodiment is the same as the image forming apparatus 100 of the first embodiment except that a third fan 118 and a fourth fan 120 are further provided, contents different from those of the first embodiment will be described, and duplicate description will be omitted.

Figure 9:
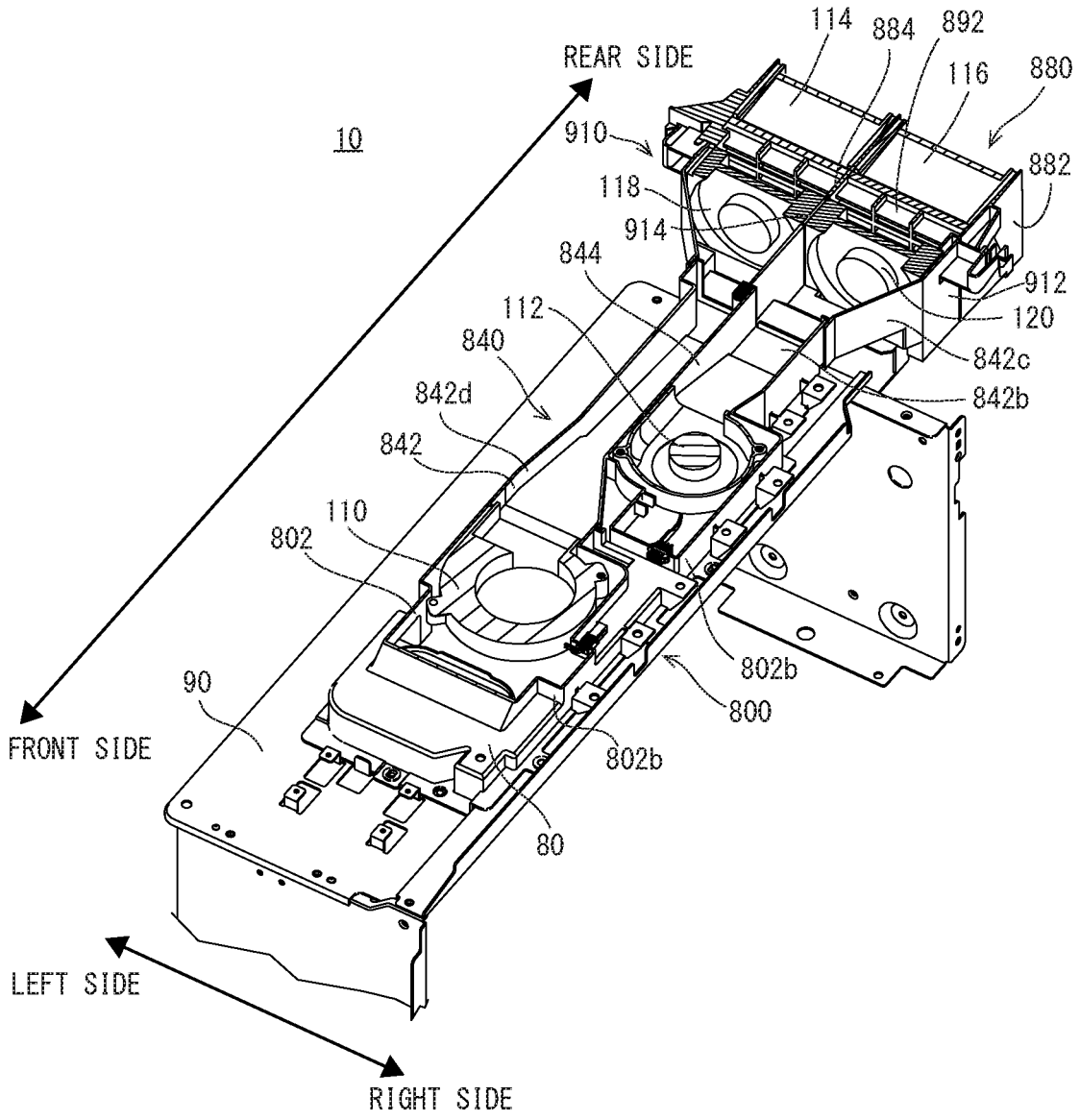
FIG. 9 is a perspective view showing an exhaust device in a second embodiment, when viewed from an upper front.

FIG. 9 is a perspective view showing an exhaust device 10 of the second embodiment, when viewed from an upper front. As shown in FIG. 9, in the exhaust device 10 of the second embodiment includes a fan holding section 910 provided between the compression section 840 and the filter holding section 880.

The fan holding section 910 includes a flow passage forming portion 912 and a boundary wall 914. The flow passage forming portion 912 is a quadrangle cylindrical member extending in the front and rear direction, and is provided continuously to the flow passage forming portion 842 of the compression section 840. A space having substantially rectangular cross-section (connecting space) is formed in an interior of the flow passage forming portion 912.

The connecting space is partitioned into a left side space and a right side space by the boundary wall 914. The left side space of the boundary wall 914 is a first connecting space that is a part of the first air passage 130, and the right side space of the boundary wall 914 is a second connecting space that is a part of the second air passage 140.

A front edge of the boundary wall 914 is abutted (closely contacted) to a rear edge of the boundary wall 844 of the compression section 840. Therefore, a front end portion of the first connecting space is communicated to the first compression space 848 (see FIG. 5), and a front end portion of the second connecting space is communicated to the second compression space 850 (see FIG. 6).

However, a flow passage cross-sectional area of the first connecting space and a flow passage cross-sectional area of the second connecting space are substantially the same. Moreover, the flow passage cross-sectional area of the first connecting space is substantially the same as a flow passage cross-sectional area at an end portion on the rear surface side of the first compression space 848. Furthermore, the flow passage cross-sectional area of the second connecting space is substantially the same as a flow passage cross-sectional area at an end portion on the rear surface side of the second compression space 850.

The third fan 118 and the fourth fan 120 are held in the fan holding section 910. The third fan 118 is provided in the first connecting space (first air passage 130). Moreover, the fourth fan 120 is provided in the second connecting space (second air passage 140). That is, the third fan 118 is provided on the downstream side of the first compression space 848, and the fourth fan 120 is provided on the downstream side of the second compression space 850.

Specifically, each of the third fan 118 and the fourth fan 120 is arranged so as to abut to the louver 892 provided in the exhaust space from the front surface side. That is, the third fan 118 and the fourth fan 120 are arranged just before the first air passage filter 114 and the second air passage filter 116 in the airflow direction, respectively.

Each of the third fan 118 and the fourth fan 120 is an axial flow fan, for example, a propeller fan. An axial direction of a rotation axis of each of the third fan 118 and the fourth fan 120 is set in the front and rear direction. Moreover, discharge directions of the third fan 118 and the fourth fan 120 are set to the rear surface side, respectively. Therefore, the third fan 118 and the fourth fan 120 send the air pressure-fed from the first fan 110 and the second fan 112 to the first air passage filter 114 and the second air passage filter 116.

According to this second embodiment, since the third fan 118 and the fourth fan 120 are provided, it is possible to uniformly send the air compressed by the first compression space 848 and the second compression space 850 into the first air passage filter 114 and the second air passage filter 116. Therefore, it is possible to increase the exhaust flow rates of the air to be discharged to the external of the apparatus main body 12 passing through the first air passage filter 114 and the second air passage filter 116, and to prevent the intake flow rate of the air sucked from the periphery of the fixing unit 44 from decreasing.

Third Embodiment

Since an image forming apparatus 100 of the third embodiment is the same as the image forming apparatus 100 of the second embodiment except that a duct main body 80 is constituted by a plurality of members (units) that are separable from each other, contents different from those of the second embodiment will be described, and duplicate description will be omitted.

Figure 10:
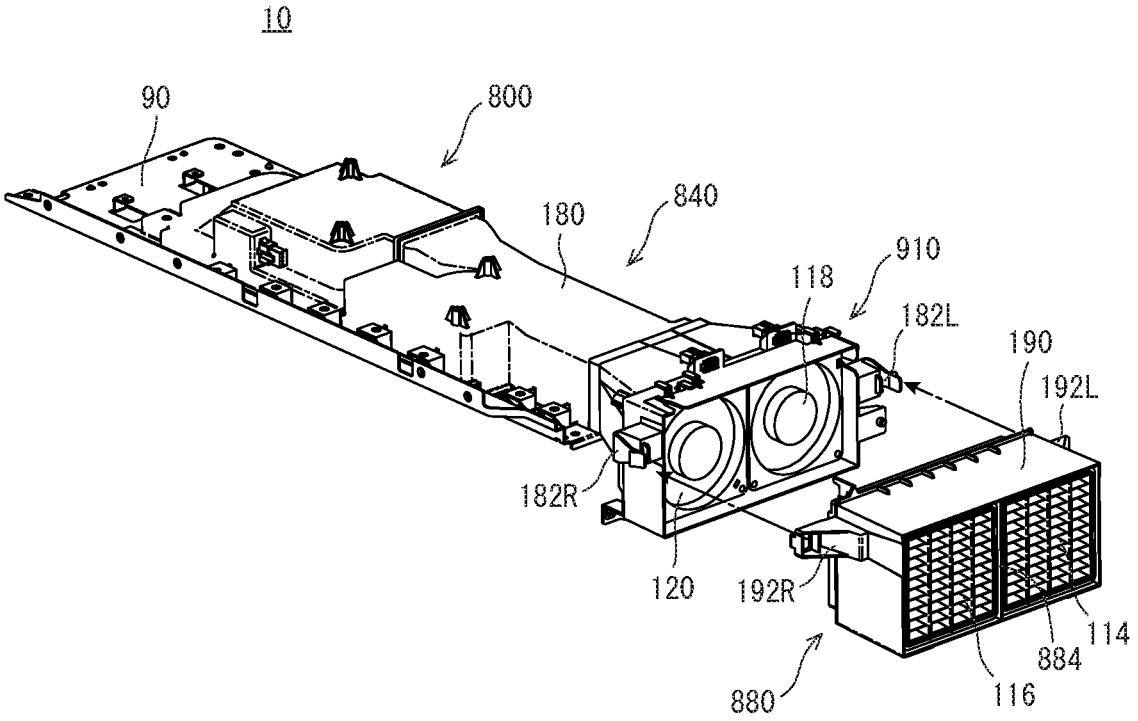
FIG. 10 is a perspective view showing an exhaust device in a third embodiment, when viewed from an upper rear.

FIG. 10 is a perspective view showing an exhaust device 10 of the third embodiment, when viewed from an upper rear. As shown in FIG. 10, the duct main body 80 is constituted by a first unit 180 and a second unit 190. The first unit 180 is attached to the duct mounting member 90 by fixing members, such as a screw(s). Moreover, the second unit 190 is attached to the rear surface side of the first unit 180.

The second unit 190 is attachably/detachably held by the first unit 18 by an engagement mechanism that makes the second unit 190 concerned engage with the first unit 18 by elastic deformation. For example, the engagement mechanism includes an engaging claw that is provided on one of the first unit 180 and the second unit 190 so as to deform elastically, and an engaging portion that is provided on the other of the first unit 180 and the second unit 190 so as to be engaged with the engaging claw. Then, the second unit 190 is held by the first unit 180 when the engaging claw and the engaging portion are engaged with each other. In this third embodiment, the engaging claw 182 is provided on the first unit 180, and the engaging portion 192 is provided on the second unit 190. Specifically, an engaging claw 182R is provided on a right end portion of the first unit 180, and an engaging claw 182L is provided on a left end portion of the first unit 180. Moreover, an engaging portion 192R is provided on a right end portion of the second unit 190, and an engaging portion 192L is provided on a left end portion of the second unit 190. The engaging claw 182R and the engaging portion 192R are provided in mutually corresponding positions. Moreover, the engaging claw 182L and the engaging portion 192L are provided in mutually corresponding positions.

Moreover, the air intake section 800, the compression section 840 and the fan holding section 910 among the plurality of portions included in the duct main body 80 are formed on the first unit 180. Therefore, the first fan 110, the second fan 112, the third fan 118 and the fourth fan 120 are held by the first unit 180. However, the air intake section 800 is formed on the frontmost side of the first unit 180, and the fan holding section 910 is formed on the rearmost side of the first unit 180.

Furthermore, the filter holding section 880 is formed in the second unit 190. Therefore, the first air passage filter 114 and the second air passage filter 116 are held in the second unit 190. That is, the second unit 190 functions as a filter holding member that holds the first air passage filter 114 and the second air passage filter 116.

Moreover, the first unit 180 and the second unit 190 function also as the air passage forming member that forms the first air passage 130 and the second air passage 140.

Figure 11A:
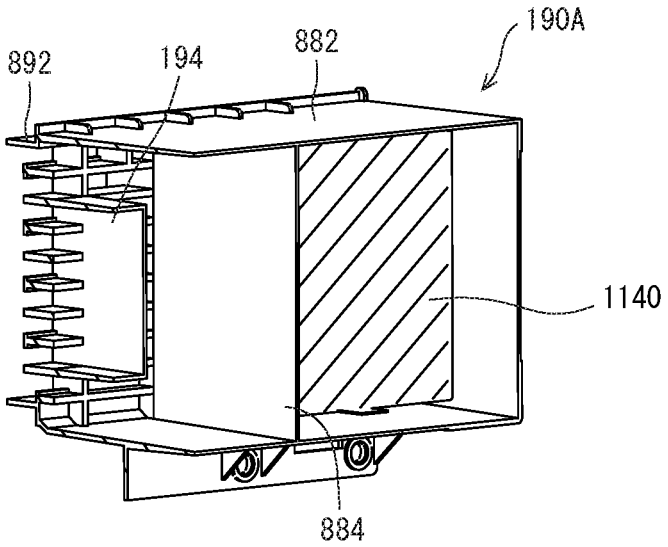
FIG. 11A is a schematic sectional view showing structure of a second unit for VOC.
Figure 11B:
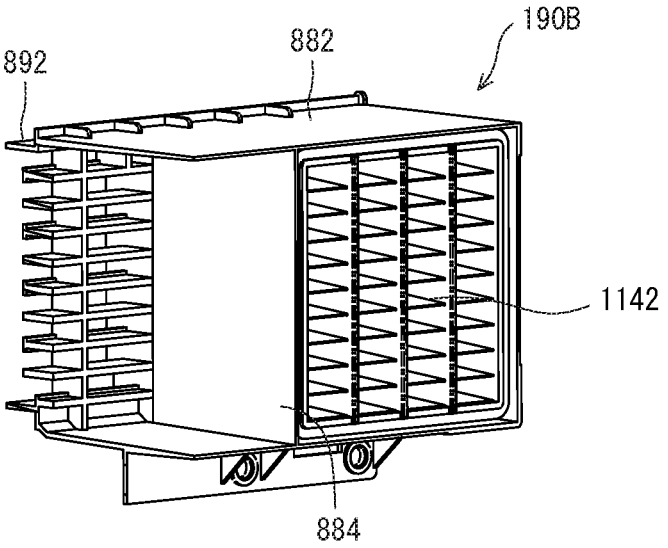
FIG. 11B is a schematic sectional view showing structure of a second unit for UFP.
Figure 12:
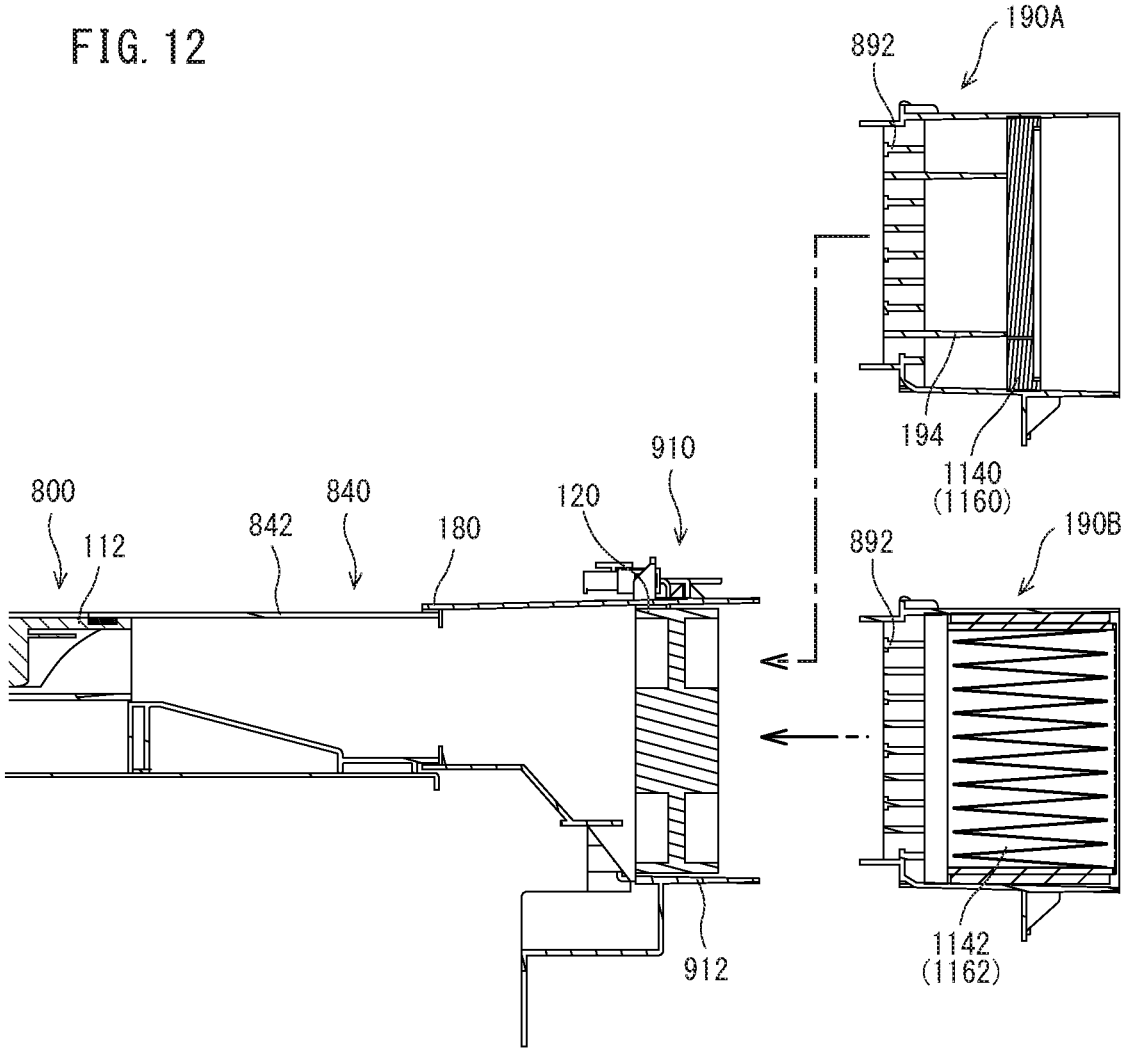
FIG. 12 is a schematic sectional view showing structure of the exhaust device including the first unit and the second unit.

FIG. 11A is a schematic sectional view showing structure of a second unit 190A for VOC. FIG. 11B is a schematic sectional view showing structure of a second unit for UFP. FIG. 12 is a schematic sectional view showing structure of the exhaust device 10 including the first unit 180 and the second unit 190.

As shown in FIGS. 11A and 11B and FIG. 12, the second unit 190 is a second unit 190A that holds the VOC filters 1140 and 1160 or a second unit 190B that holds the UFP filters 1142 and 1162.

Outer shapes of the second unit 190A for VOC and the second unit 190B for UFP are the same. Therefore, the second unit 190A for VOC and the second unit 190B for UFP can be installed exchangeably.

A rib 194 extending in the front and rear direction is formed in an interior of the second unit 190A for VOC. The rib 194 is formed integrally with the louver 892 to be extended toward the rear surface side from the louver 892. For example, an end portion on the rear surface side of the rib 194 is located in substantially the center portion of the second unit 190A for VOC in the front and rear direction. In the second unit 190A for VOC, the VOC filters 1140 and 1160 are arranged so as to be brought into contact to the end portion on the rear surface side of the rib 194. That is, positions of the VOC filter 1140 and 1160 in the front and rear direction are regulated by the rib 194. Therefore, it is possible to prevent the UFP filters 1142 and 1162 from being erroneously attached to the second unit 190A for VOC. As described above, the second unit 190A for VOC and the second unit 190B for UFP have different internal structures.

Moreover, the second unit 190B may be set to hold both the UFP filters 1142 and 1162 and the VOC filters 1140 and 1160 rather only the UFP filters 1142 and 1162. According to this third embodiment, since the duct main body 80 is constituted by a combination of the first unit 180 and the second unit 190 mutually separatable from each other, it is possible to manufacture easily the exhaust duct of the above-described complicated structure.

Moreover, in the third embodiment, the second unit 190 holding the first air passage filter 114 and the second air passage filter 116 is provided in the first unit 180 in an attachable/detachable manner. Therefore, since the first air passage filter 114 and the second air passage filter 116 can be attached to the exhaust device 10 together with the second unit 190 or removed from the exhaust unit 10 together with the second unit 190, a replacement work of the first air passage filter 114 and the second air passage filter 116 is simple. Moreover, both the first air passage filter 114 and the second air passage filter 116 can be exchanged without soiling a hand.

Furthermore, in the third embodiment, the second unit 190A for VOC and the second unit 190B for UFP can be installed exchangeably. Therefore, when changing the specification of the filter of the image forming apparatus 100, it is only necessary to replace the second unit 190A for VOC or the second unit 190B for UFP, so the replacement work is simple.

Furthermore, according to the third embodiment, since the rib 194 extending toward the rear surface side from the louver 892 is formed in the interior of the second unit 190A for VOC, it is easy to attach the VOC filters 1140 and 1160.

Moreover, although the third fan 118 and the fourth fan 120 are provided in the third embodiment, should not be limited to this. When the intake flow rate of the air sucked from the periphery of the fixing unit 44 can be secured only by the first fan 110 and the second fan 112, it is possible to omit the third fan 118 and the fourth fan 120 like the first embodiment. In this way, the structure of the exhaust device 10 can be simplified, the number of components can be reduced, and thus, a manufacturing cost can be reduced.

Furthermore, when using the second unit 190A for VOC, since only the VOC filters 1140 and 1160 each having the low airflow resistance are used, the first fan 110 and the second fan 112 are omissible. In this way, the structure of the exhaust device 10 can be simplified, the number of components can be reduced, and thus, a manufacturing cost can be reduced.

Furthermore, although the second unit 190 is held on the first unit 180 by the engagement mechanism in the third embodiment, there is no necessity of being limited to this. Instead of or in addition to the engagement mechanism, the second unit 190 may be held on the first unit 180 by fixing members, such as a screw(s). In this way, it is possible to prevent the second unit 190 from being separated from the first unit 180 by the pressure of the airflow in the exhaust device 10.

Fourth Embodiment

Since an image forming apparatus 100 of the fourth embodiment is the same as the image forming apparatus 100 of the third embodiment except that a part of the duct main body 80 is constituted by a third unit 200, contents different from those of the third embodiment will be described, and duplicate description will be omitted.

Figure 13:
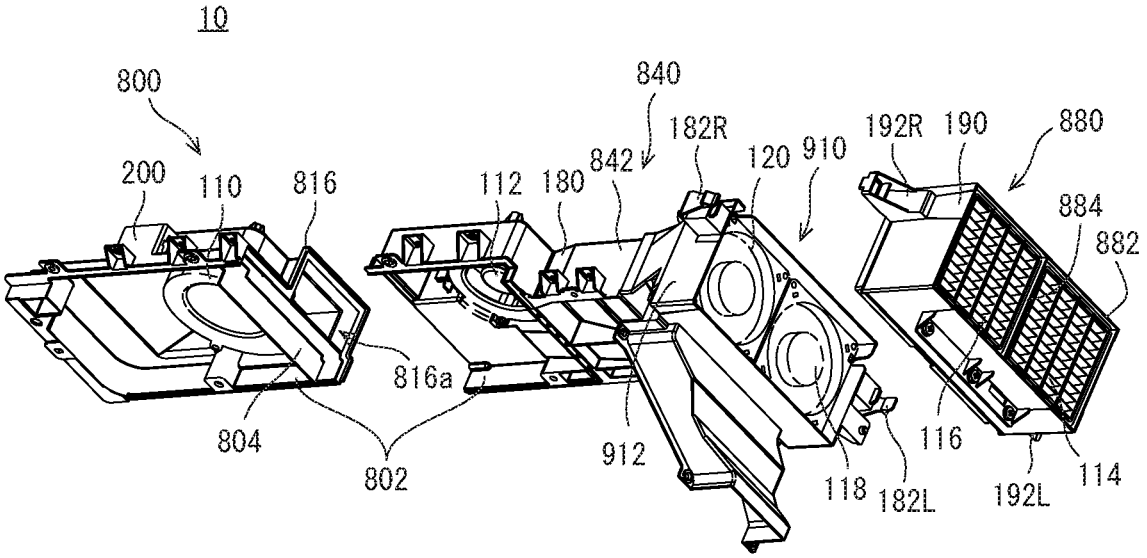
FIG. 13 is a perspective view showing an exhaust device of a fourth embodiment, when viewed from a lower rear.
Figure 14:
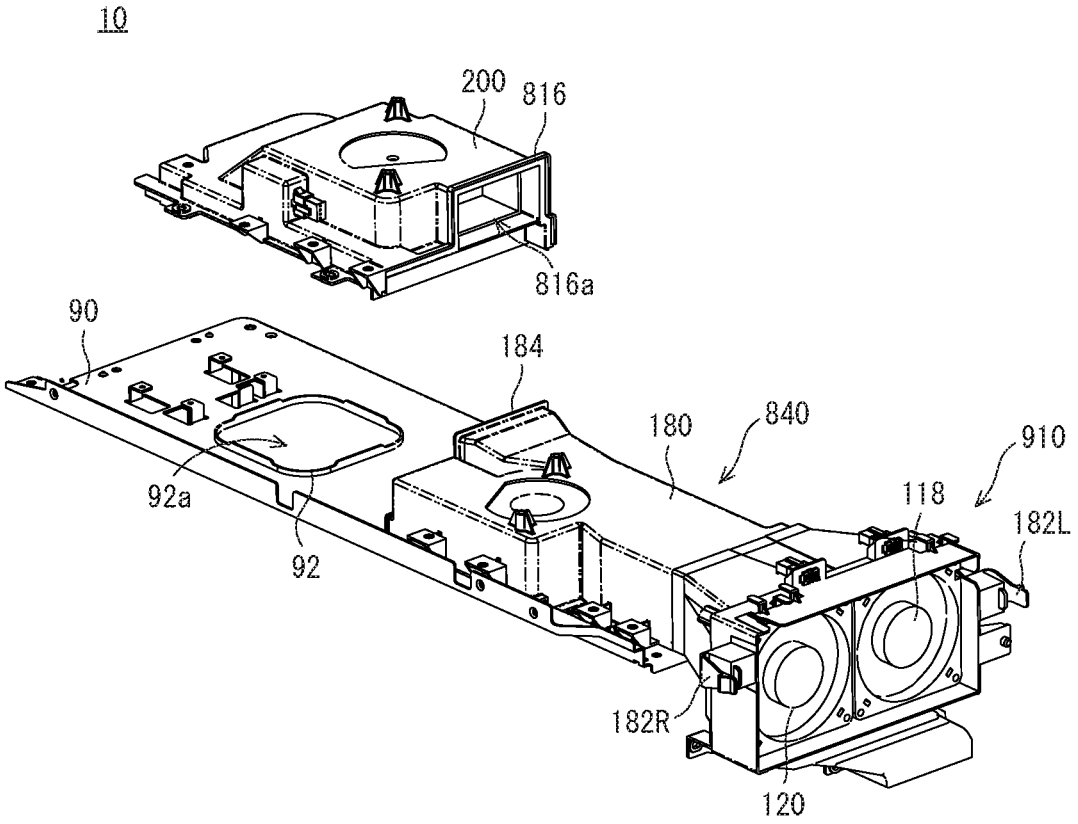
FIG. 14 is a perspective view showing the exhaust device in a state of detaching a third unit, when viewed from an upper front.

FIG. 13 is a perspective view showing an exhaust device 10 of the fourth embodiment, when viewed from a lower rear. FIG. 14 is a perspective view showing the exhaust device 10 in a state of detaching the third unit 200, when viewed from an upper front.

As shown in FIG. 13 and FIG. 14, in the image forming apparatus 100 of the fourth embodiment, a part of the front surface side of the first unit 180 is divided as the third unit 200. Therefore, the duct main body 80 is constituted by the first unit 180 (corresponding to a second air passage forming member), the second unit 190, and the third unit 200 (corresponding to a first air passage forming member).

Apart from the first unit 180, the third unit 200 is attached to the duct mounting member 90 by fixing members, such as a screw(s).

In the fourth embodiment, a part of the front surface side of the air intake section 800 is formed in the third unit 200. Moreover, a part of the rear surface side of the air intake section 800, the compression section 840 and the fan holding section 910 are formed in the first unit 180. That is, the air intake section 800 is formed by the third unit 200 and the first unit 180.

Specifically, the third unit 200 includes a part of the front surface side of the air intake section 800 and the boundary wall 804. That is, a boundary between the third unit 200 and the first unit 180 is the rear surface side compared to the boundary wall 804. Therefore, the first air intake space 808 arranged on the front surface side of the boundary wall 804 is formed by the third unit 200 and the duct mounting member 90.

Moreover, the second air intake space 810 arranged on the rear surface side of the boundary wall 804 is formed by a part of the third unit 200, a part of the front surface side of the first unit 180 and the duct mounting member 90.

Moreover, in the fourth embodiment, the third opening end 816 is formed in the end portion on the rear surface side of the third unit 200. Therefore, the first communicating port 816*a* is formed in the end portion on the rear surface side of the third unit 200.

Furthermore, a seventh opening end 184 corresponding to the third opening end 816 is formed in the end portion on the front surface side of the first unit 180. Although it is difficult to understand from FIG. 13 and FIG. 14, a communicating port that is communicated with the first compression space 848 is formed by the seventh opening end 184. The first air intake space 808 and the first compression space 848 are communicated with each other by this communicating port.

As described above, the third unit 200 forms a part of the first air passage 130 (first air intake space 808). Moreover, the first unit 180 forms a part of the second air passage 140 and another part of the first air passage 130 (portions other than first air intake space 808).

Furthermore, in the fourth embodiment, the first fan 110 is provided in the third unit 200. The second fan 112 is provided in the first unit 180.

According to this fourth embodiment, since a part of the front surface side of the first unit 180 is divided as the third unit 200, it is possible to simplify metal mold structure. That is, a member that forms a complicated air passage can be easily manufactured.

Moreover, according to the fourth embodiment, since the first fan 110 is provided in the third unit 200, when replacing the first fan 110, the replacement of the first fan 110 can be implemented by detaching only the third unit 200 from the duct mounting member 90. Similarly, since the second fan 112 is provided in the first unit 180, when replacing the second fan 112, the replacement of the second fan 112 can be implemented by detaching only the first unit 180 from the duct mounting member 90. Therefore, the replacement work of the first fan 110 and the second fan 112 is simple.

Fifth Embodiment

Since an image forming apparatus 100 of the fifth embodiment is the same as the image forming apparatus 100 of the fourth embodiment except that a part of the duct main body 80 is constituted by a fourth unit 210, contents different from those of the fourth embodiment will be described, and duplicate description will be omitted.

Figure 15:
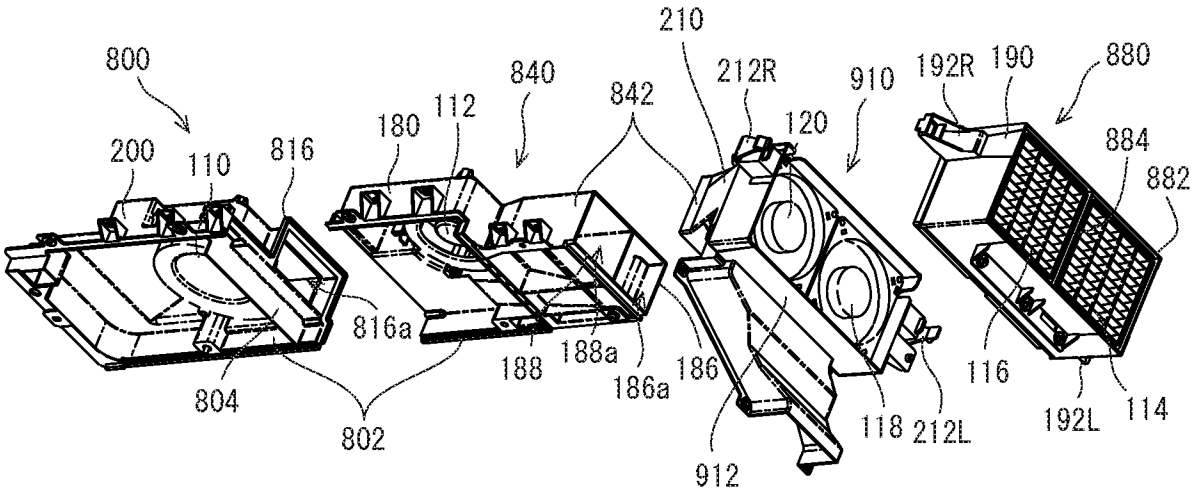
FIG. 15 is a perspective view showing an exhaust device of a fifth embodiment, when viewed from a lower rear.

FIG. 15 is a perspective view showing an exhaust device 10 of the fifth embodiment, when viewed from a lower rear. As shown in FIG. 15, in the image forming apparatus 100 of the fifth embodiment, a part of the rear surface side of the first unit 180 is divided as the fourth unit 210. Therefore, the duct main body 80 is constituted by the first unit 180 (corresponding to the second air passage forming member), the second unit 190, the third unit 200 (corresponding to the first air passage forming member) and the fourth unit (corresponding to the fan holding member) 210.

The fourth unit 210 is held on the first unit 180 in an attachable/detachable manner by an engagement mechanism or fixing members, such as a screw(s).

Moreover, in the fifth embodiment, the second unit 190 is held on the fourth unit 210 in a manner attachable/detachable manner by an engagement mechanism or fixing members, such as a screw(s). In the fifth embodiment, the second unit 190 is held on (connected to) the fourth unit 210 by an engagement mechanism. Therefore, engaging claws 212R and 212L corresponding to the engaging claws 182R and 182L of the third embodiment are formed in both end portions in the left and right direction of the fourth unit 210. Therefore, in the fifth embodiment, it is possible to detach only the second unit 190 from the duct main body 80, and detach the second unit 190 and the fourth unit 210 from the duct main body 80 altogether.

In the fifth embodiment, a part of the rear surface side of the compression section 840 and the fan holding section 910 are formed in the fourth unit 210. That is, the fourth unit 210 constitutes the first air passage 130 and a part of the second air passage 140.

A boundary between the fourth unit 210 and the first unit 180 is the rear surface side compared to the second air intake space 810 at least. That is, the boundary between the fourth unit 210 and the first unit 180 is set in the middle of the compression section 840.

Moreover, an eighth opening end 186 and a ninth opening end 188 are formed in the end portion on the rear surface side of the first unit 180. A tenth opening end (not shown) and an eleventh opening end 214 are formed in the end portion on the front surface side of the fourth unit 210. The eighth opening end 186 and the tenth opening end are formed in positions that correspond to the first compression space 848 and correspond to each other. The ninth opening end 188 and the eleventh opening end 214 are formed in positions that correspond to the second compression space 850 and correspond to each other.

Via the communicating ports that are formed by the eighth opening end 186 and the ninth opening end 188, the first compression space 848 on a side of the fourth unit 210 and the first compression space 848 on a side of the first unit 180 are communicated to each other, and the second compression space 850 on a side of the fourth unit 210 and the second compression space 850 on a side of the first unit 180 are communicated to each other.

According to the fifth embodiment, since a part of the rear surface side of the first unit 180 is divided as the fourth unit 210, it is possible to manufacture a member that forms a complicated air passage more easily.

Sixth Embodiment

Since an image forming apparatus 100 of the sixth embodiment is the same as the image forming apparatus 100 of the first embodiment except that a main body side air passage 150 is formed, contents different from those of the first embodiment will be described, and duplicate description will be omitted.

Figure 16:
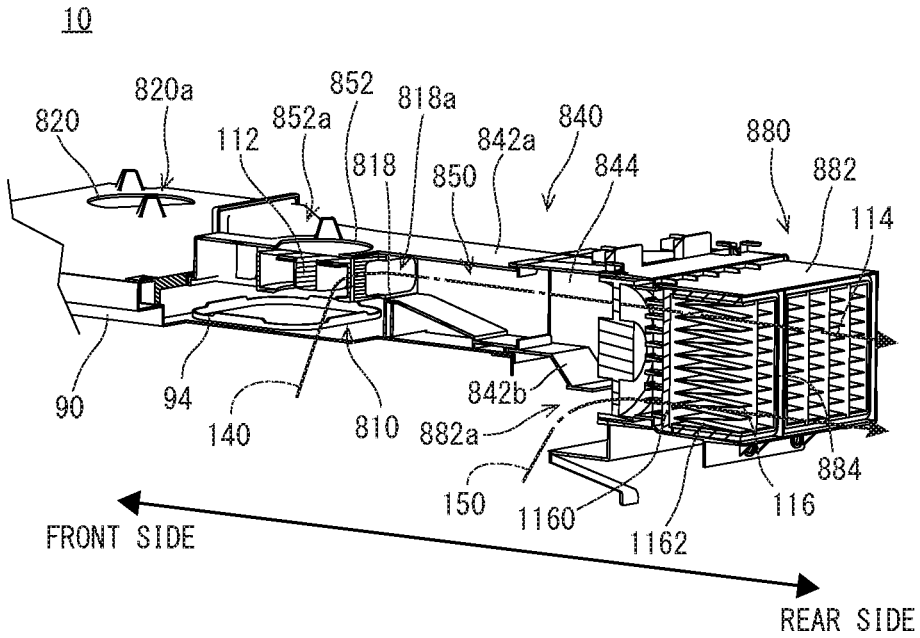
FIG. 16 is a schematic sectional view showing a second air passage and a third air passage in a sixth embodiment.

FIG. 16 is a schematic sectional view showing the second air passage 140 and the main body side air passage 150 in the sixth embodiment. As shown in FIG. 16, in the image forming apparatus 100 of the sixth embodiment, on the upstream side of the fourth fan 120, the main body side air passage 150 is formed separately from the second compression space 850. Although illustration is omitted, this main body side air passage 150 is formed inside the rear surface side of the image forming apparatus 100, for example. Specifically, the main body side air passage 150 is formed between a support frame for supporting a plurality of components included in the image forming portion 30 and a side wall of the apparatus main body 12.

This main body side air passage 150 is a cooling air passage for sucking the air in a space of the rear surface side of the fixing unit 44.

An upper side portion of this main body side air passage 150 is formed with the bottom wall 842*b* of the second air passage 140. More specifically, an upper end portion of the main body side air passage 150 is connected to a third communicating port 882*a* that is formed in the bottom surface of the passage forming portion 882.

According to this sixth embodiment, since the main body side air passage 150 is connected to the upstream side in the airflow compared to the fourth fan 120, the air can be sucked from a space other than the space above the fixing unit 44, and substances such as UFP can be sucked more efficiently. Moreover, since it is possible to make the fourth fan 120 function as an exhaust fan in the main body side air passage 150, the structure of the exhaust device 10 is made to be simplified, the number of components can be reduced, and in turn, a manufacturing cost can be reduced. Moreover, another main body side air passage similar to the main body side air passage 150 may be provided on the upstream side of the third fan 118.

Moreover, according to the sixth embodiment, since the main body side air passage 150 is connected to the upstream side of the airflow compared to the second air passage filter 116, even if VOC, ozone, UFP, etc. are included in the air that flows through the main body side air passage 150, the VOC, ozone, UFP, etc. can be collected by the second air passage filter 116. Moreover, the main body side air passage 150 may be connected to the upstream side of the first air passage filter 114.

Furthermore, in the image forming apparatus 100 of the sixth embodiment, a fifth opening end 820 and a sixth opening end 852 are formed in the top wall 802*a* of the passage forming portion 802 of the air intake section 800. The fifth opening end 820 is formed in a position corresponding (is brought into contact) to the first fan 110.

The sixth opening end 852 is formed in a position corresponding (is brought into contact) to the second fan 112. Moreover, the fifth opening end 820 is formed with the rotation axis of the first fan 110 as the center, and is formed smaller than an outer shape of the first fan 110. Moreover, the sixth opening end 852 is formed with the rotation axis of the second fan 112 as the center, and is formed smaller than an outer shape of the second fan 112.

In this way, since the heat of a portion of a motor that drives the first fan 110 is radiated from the fourth communicating port 820*a* formed by the fifth opening end 820, it is possible to prevent the drive motor of the first fan 110 from accumulating the heat and thus being damaged due to the heat. Similarly, the heat of a portion of a motor that drives the second fan 112 can be radiated from the fifth communicating port 852*a* formed by the sixth opening end 852.

Moreover, although illustration is omitted, a sealing member is sandwiched between the top wall 802*a* of the passage forming portion 802 of the air intake section 800 and the first fan 110, thereby preventing the air from being leaked.

Figure 17:
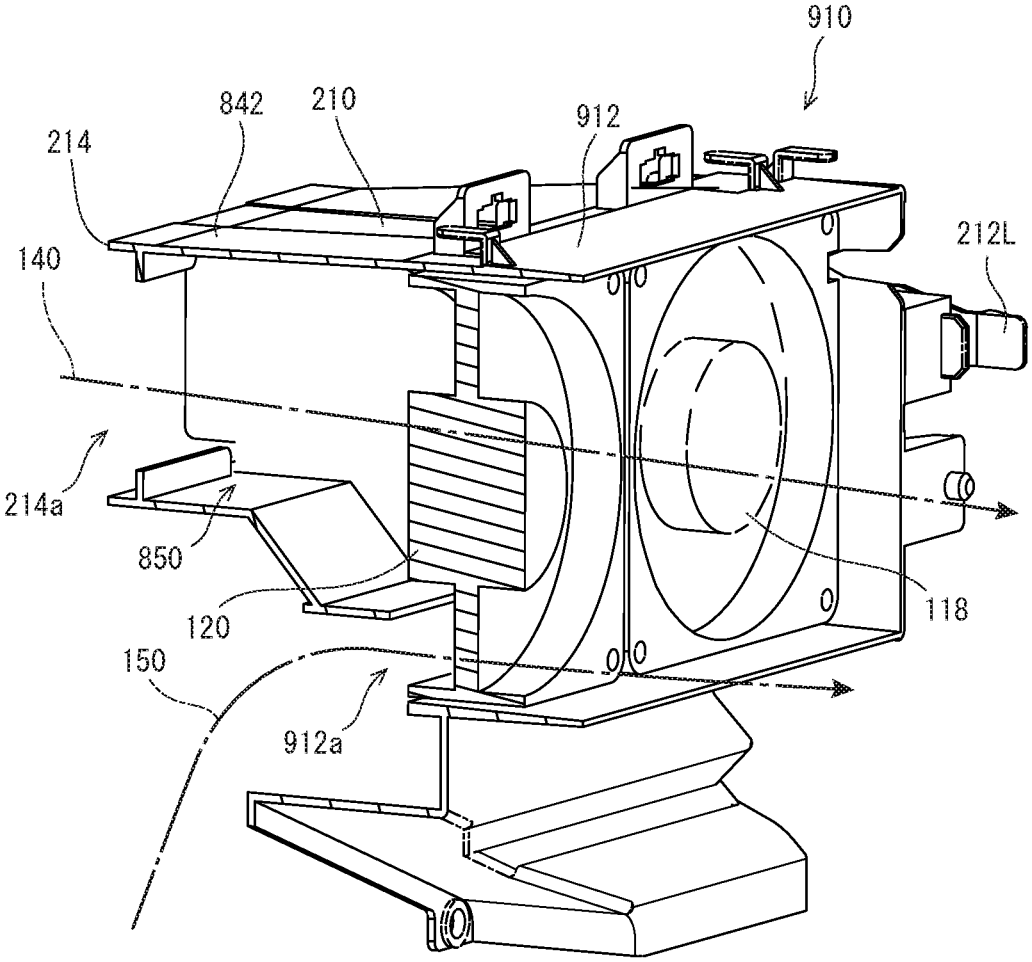
FIG. 17 is a schematic sectional view showing a second air passage and a third air passage in a modified example.

In addition, the structure shown in the sixth embodiment can be adopted also in one or more of the second embodiment to the fifth embodiment to be combined. FIG. 17 is a schematic cross-sectional view showing the second air passage and the third air passage in a modified example. For example, if the structure shown in the sixth embodiment is combined with the fifth embodiment, as shown in FIG. 17, the fourth unit 210 constitutes portions of the upstream side of the airflow in the first air passage 130 and the second air passage 140 compared to the third fan 118 and the fourth fan 120, respectively, and therefore, it is possible to easily form the third communicating port 912*a* for making the main body side air passage 150 join to the first air passage 130 and the second air passage 140.

Seventh Embodiment

Since an image forming apparatus 100 of the seventh embodiment is the same as the image forming apparatus 100 of the first embodiment except that a heater 72 is provided, contents different from those of the first embodiment will be described, and duplicate description will be omitted.

Figure 18:
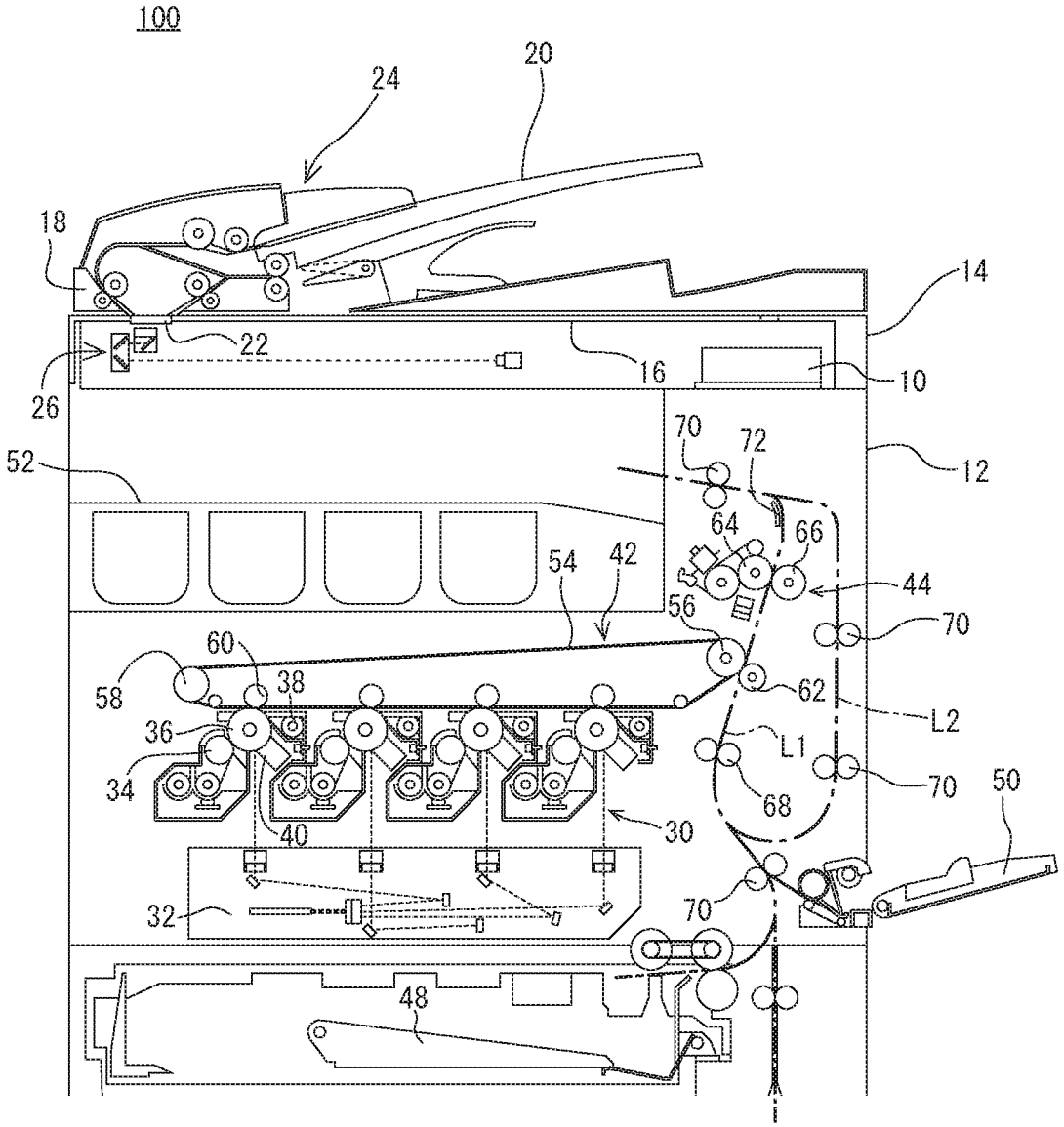
FIG. 18 is an illustration view showing schematic structure of an image forming apparatus in a seventh embodiment.

FIG. 18 is an illustration view showing schematic structure of the image forming apparatus 100 of the seventh embodiment. As shown in FIG. 18, the image forming portion 30 is provided with the heater 72 in the image forming apparatus 100 of the seventh embodiment.

The heater 72 is arranged on the downstream side of the sheet feeding direction of the fixing unit 44 of the first sheet feeding path L1. As described above, the first sheet feeding path L1 is the vertical feeding path that feeds a sheet in the vertical direction. Therefore, the heater 72 is arranged above the fixing unit 44.

However, the heater 72 is arranged on the upstream side of the sheet feeding direction compared to the feeding roller 70 near the sheet discharge tray 52. Moreover, the heater 72 is arranged on the upstream side of the sheet feeding direction compared to a position that the second sheet feeding path L2 branches from the first sheet feeding path L1 in the downstream side of the sheet feeding direction of the fixing unit 44. Therefore, the heater 72 is provided between the fixing unit 44 and the exhaust device 10. This can be said that the heater 72 is arranged in the middle of the flow of the air sucked by the exhaust duct.

The heater 72 is arranged on the back side of a sheet feeding guide 74 provided on the downstream side of the fixing unit 44. The sheet feeding guide 74 is a member that guides the sheet to be fed after fixing of the toner image. Although illustration is omitted, the sheet feeding guide 74 has a plurality of guide ribs and vent holes in a base plate portion that supports the guide ribs at their roots. The guide ribs and the vent holes are alternately arranged in the width direction of the sheet. Moreover, the guide ribs and the vent holes are formed vertically long in the sheet feeding direction.

The heater 72 is, for example, an electric heater, and generates heat (for example, room temperature plus (+) about 5 to 20 degrees) when power is supplied from a power supply not shown. Since the heater 72 heats the air in a space of the sheet feeding path on the downstream side of the fixing unit 44 through the vent holes of the sheet feeding guide 74, a relative humidity in this space can be lowered. That is, since it is possible to reduce the amount of moisture coupled to VOC generated when the sheet on which an unfixed toner image is formed in the fixing portion is heated, it is possible to suppress the generation amount of UFP that is said to be generated when coupling VOC and moisture in the air.

As described above, in the seventh embodiment, since the generation amount of UFP is suppressed, it is possible to omit or miniaturize the UFP filters 1142 and 1162. In this way, the structure of the exhaust device 10 can be simplified, the number of components can be reduced, and thus, a manufacturing cost can be reduced.

In addition, the structure shown in the seventh embodiment can be adopted also in one or more of the second embodiment to the sixth embodiment to be combined.

As described above, although the present invention has been described with reference to specific embodiments, the present invention is not limited to the above-described embodiments. It should be noted that the above-described specific embodiments are all mere examples, and to be changed appropriately in accordance with specifications of the actual products.

Although the present invention has been described and illustrated in detail, it is clearly understood that the same is by way of illustration and example only and is not to be taken by way of limitation, the spirit and scope of the present invention being limited only by the terms of the appended claims. Furthermore, it is intended that the scope of the present invention covers all modifications within the meaning and range of equivalency of the claims.

What is claimed is:

1. An image forming apparatus, comprising:

an apparatus main body;

a fixing portion configured to fix a toner image that is transferred on a recording medium with heating;

an exhaust duct configured to form a first air passage that is formed in a quadrangle cylindrical shape having a bottom surface and a top surface, and has a first air inlet through which air from the fixing portion passes, and leads the air to an external of the apparatus main body;

a first air passage filter provided in the first air passage; and a first centrifugal fan that is provided on a side of the first air inlet compared to the first air passage filter in the first air passage, and sucks the air through the first air inlet and pressure-feeds the air to the first air passage filter, wherein a flow passage cross-sectional area between the first centrifugal fan and the first air passage filter in the first air passage becomes larger toward a downstream side of an airflow.

2. The image forming apparatus according to claim 1, wherein the first air passage includes a compression space that is formed between the first centrifugal fan and the first air passage filter.

3. The image forming apparatus according to claim 2, wherein the compression space has a flow passage cross-sectional area that becomes larger toward a downstream side of airflow.

4. The image forming apparatus according to claim 1, wherein an axial direction of the first centrifugal fan is set in an up and down direction, and the first centrifugal fan is arranged on a side of the top surface of the first air passage, and the first air passage includes an air intake space between the first centrifugal fan and the first air inlet.

5. The image forming apparatus according to claim 1, further comprising a first axial flow fan that is provided between the first centrifugal fan and the first air passage filter in the first air passage, and sends air pressure-fed by the first centrifugal fan to the first air passage filter.

6. The image forming apparatus according to claim 5, further comprising a main body side air passage that is formed in an interior of the apparatus main body separated from the first air passage, wherein the main body side air passage is connected to a communicating port formed on an upstream side compared to the first axial fan in an airflow.

7. The image forming apparatus according to claim 1, further comprising:

a second air passage that is formed in parallel to the first air passage in the exhaust duct, and has a second air inlet through which air from the fixing portion passes, and leads the air to the external of the apparatus main body;

a second air passage filter provided in the second air passage; and a second centrifugal fan that is provided on a side of the second air inlet compared to the second air passage filter in the second air passage, and sucks the air through the second air inlet and pressure-feeds the air to the second air passage filter.

8. The image forming apparatus according to claim 7, wherein the second air passage includes a compression space formed between the second centrifugal fan and the second air passage filter.

9. The image forming apparatus according to claim 8, wherein the compression space has a flow passage cross-sectional area that becomes larger toward a downstream side of airflow.

10. The image forming apparatus according to claim 7, wherein an axial direction of the second centrifugal fan is set in an up and down direction, and the second centrifugal fan is arranged on a side of the top surface of the second air passage, and the second air passage includes an air intake space between the second centrifugal fan and the second air inlet.

11. The image forming apparatus according to claim 7, further comprising a second axial flow fan that is provided between the second centrifugal fan and the second air passage filter in the second air passage, and sends air pressure-fed by the second centrifugal fan to the second air passage filter.

12. The image forming apparatus according to claim 11, further comprising a main body side air passage that is formed in an interior of the apparatus main body separated from the second air passage, wherein the main body side air passage is connected to a communicating port formed on an upstream side compared to the second axial fan in an airflow.

13. The image forming apparatus according to claim 10, wherein a part of the first air passage and a part of the second air passage are overlap with each other in the up and down direction.

14. The image forming apparatus according to claim 1, further comprising a heater that is provided between the fixing portion and the exhaust duct.

15. The image forming apparatus according to claim 7, further comprising a heater that is provided between the fixing portion and the exhaust duct.

16. The image forming apparatus according to claim 1, wherein the exhaust duct is constituted with a plurality of separable members.

17. The image forming apparatus according to claim 16, wherein at least one of the plurality of members is a filter holding member that holds the first air passage filter, the filter holding member being detachably attached to the exhaust duct.

18. The image forming apparatus according to claim 17, wherein the filter holding member has internal structure according to number and sizes of filter held in an internal of the filter holding member.

19. The image forming apparatus according to claim 16, wherein the first air passage includes the first centrifugal fan and a first compression space that is formed between the first centrifugal fan and the first air passage filter, and at least one of the plurality of members comprises the first centrifugal fan and defines an air intake space.

20. The image forming apparatus according to claim 16, further comprising a first axial flow fan that is provided between the first centrifugal fan and the first air passage filter in the first air passage, and sends the air pressure-fed by the first centrifugal fan to the first air passage filter, wherein at least one of the plurality of members is a fan holding member that holds the first centrifugal fan.

21. The image forming apparatus according to claim 16, further comprising:

a second air passage that is formed in parallel to the first air passage in the exhaust duct, and has a second air inlet through which air from the fixing portion passes, and leads the air to the external of the apparatus main body;

a second air passage filter provided in the second air passage; and a second centrifugal fan that is provided on a side of the second air inlet compared to the second air passage filter in the second air passage, and sucks air through the second air inlet and pressure-feeds the air to the second air passage filter, wherein the second air passage includes an air intake space between the second centrifugal fan and the second air passage filter, and at least one of the plurality of members comprises the second centrifugal fan, and defines the air intake space.

* * * * *